US010137042B2

(12) United States Patent
Ishikawa et al.

(10) Patent No.: US 10,137,042 B2
(45) Date of Patent: Nov. 27, 2018

(54) TRAVELLING APPARATUS

(71) Applicants: THE UNIVERSITY OF TOKYO, Tokyo (JP); TOYOTA JIDOSHA KABUSHIKI KAISHA, Toyota-shi, Aichi-ken (JP)

(72) Inventors: Masaru Ishikawa, Tokyo (JP); Kiyoshi Matsumoto, Tokyo (JP); Tomoyuki Takahata, Tokyo (JP); Isao Shimoyama, Tokyo (JP); Takashi Izuo, Toyota (JP); Yoshihiro Kuroki, Yokohama (JP); Taro Takahashi, Tokyo (JP); Yusuke Kosaka, Tokyo (JP)

(73) Assignees: THE UNIVERSITY OF TOKYO, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/324,362

(22) PCT Filed: Jul. 9, 2015

(86) PCT No.: PCT/JP2015/003457
§ 371 (c)(1),
(2) Date: Jan. 6, 2017

(87) PCT Pub. No.: WO2016/006248
PCT Pub. Date: Jan. 14, 2016

(65) Prior Publication Data

US 2017/0172823 A1 Jun. 22, 2017

(30) Foreign Application Priority Data

Jul. 11, 2014 (JP) ..... 2014-143572

(51) Int. Cl.
*B61G 5/06* (2006.01)
*A61G 5/06* (2006.01)
(Continued)

(52) U.S. Cl.
CPC ..... *A61G 5/06* (2013.01); *A61G 5/04* (2013.01); *A61G 5/042* (2013.01); *A61G 5/061* (2013.01); *A61G 5/1059* (2013.01); *A61G 5/068* (2013.01)

(58) Field of Classification Search
CPC ..... A61G 5/04; A61G 5/06; A61G 5/061
(Continued)

(56) References Cited

U.S. PATENT DOCUMENTS 9,073,399 B1 * 7/2015 Richter ..... B60G 17/0165
2004/0060748 A1 * 4/2004 Molnar ..... A61G 5/043 180/65.1
(Continued)

FOREIGN PATENT DOCUMENTS

JP 2007-061342 A 3/2007
JP 2007-167611 A 7/2007
(Continued)

*Primary Examiner* — Jacob D Knutson
(74) *Attorney, Agent, or Firm* — Sughrue Mion, PLLC

(57) ABSTRACT

The travelling apparatus according to exemplary embodiments includes front wheels, which are driving wheels, an upper frame, first linear motion mechanisms configured to be extendable and retractable and couple the front wheels to the upper frame, middle wheels configured to be disposed at a back of the front wheels, second linear motion mechanisms configured to be extendable and retractable and couple a riding part to the middle wheels, rear wheels configured to be disposed at a back of the middle wheels, lower links configured to couple the middle wheels to the rear wheels, respectively, rear links configured to couple the lower links to the upper frame, and a third linear motion mechanism
(Continued)

configured to change an angle between the upper frame and the rear links.

17 Claims, 21 Drawing Sheets

(51) Int. Cl.
*A61G 5/04* (2013.01)
*A61G 5/10* (2006.01)

(58) Field of Classification Search
USPC ..... 280/5.28, 5.32
See application file for complete search history.

(56) References Cited

U.S. PATENT DOCUMENTS

2015/0015043 A1* 1/2015 Jahkel ..... A61G 5/1059
297/326
2015/0374564 A1* 12/2015 Sutton ..... A61G 5/061
280/657

FOREIGN PATENT DOCUMENTS

JP 2013-208245 A 10/2013
JP 2013-208246 A 10/2013

* cited by examiner

TRAVELLING APPARATUS

CROSS REFERENCE TO RELATED APPLICATIONS

This is a National Stage of International Application No. PCT/JP2015/003457 filed Jul. 9, 2015, claiming priority based on Japanese Patent Application No. 2014-143572 filed Jul. 11, 2014, the contents of all of which are incorporated herein by reference in their entirety.

TECHNICAL FIELD

The present invention relates to a travelling apparatus.

BACKGROUND ART

Vehicles for the elderly and the disabled such as electric wheelchairs and mobility scooters are not suitable for uneven terrains, slopes, and large steps. Wheelchairs are difficult to get on escalators. Further, mobility scooters cannot be brought on trains and buses. As there are concerns about accidents where mobility scooters fall sideways, the mobility scooters are not suitable for usage environments where steps and slopes are present on the sides of the mobility scooters, and thus the mobility scooters need to travel at a low speed in order to travel safely.

Patent Literature 1 discloses a wheelchair that can ascend and descend stairs. The wheelchair disclosed in Patent Literature 1 includes six wheels. Right and left front wheels are driving wheels. Two other wheels are arranged on one side of the wheelchair behind the right and left front wheels. The six-wheel grounded state enables the wheelchair to ascend and descend stairs. When the wheelchair travels on a flat surface, four wheels of the wheelchair are grounded. The wheels are coupled to a chair part with serial link arm mechanisms interposed therebetween. The wheelchair can ascend and descend stairs with different right and left heights by controlling the right and left serial link arm mechanisms.

CITATION LIST

Patent Literature

Patent Literature 1: Japanese Unexamined Patent Application Publication No. 2013-208246

SUMMARY OF INVENTION

Technical Problem

In Patent Literature 1, the serial link arm mechanisms are provided for the respective four wheels. The serial link arm mechanisms each have two degrees of freedom. For this reason, eight actuators are needed to change an arm angle of the serial link arm mechanism. When the number of the actuators is increased, the device structure will become larger, complicated, and heavier.

The present invention has been made in light of the above problem, and an object of the present invention is to provide a travelling apparatus that has a simple structure and can be applied to various environments.

Solution to Problem

In an exemplary aspect of the present invention, a travelling apparatus includes: a first wheel, which is a driving wheel; a vehicle body; a first linear motion mechanism configured to be extendable and retractable and couple the first wheel to the vehicle body; a second wheel configured to be disposed at a back of the first wheel; a second linear motion mechanism configured to be extendable and retractable and couple the second wheel to the vehicle body; a third wheel configured to be disposed at a back of the second wheel; a first link configured to couple the second wheel to the third wheel; a second link configured to couple the first link to the vehicle body; and an actuator configured to change an angle between the vehicle body and the second link.

In the above traveling apparatus, the first wheels, the second wheels, the third wheels, the first linear motion mechanisms, and the second linear motion mechanisms may be arranged on right and left sides of the vehicle and may be driven independently on the right and left sides of the vehicle.

In the above vehicle, the actuator may be shared by the right and left second links.

In the above travelling apparatus, the second wheels and the third wheels may be trailing wheels.

In the above travelling apparatus, the actuator may include a third linear motion mechanism provided in an extendable and retractable manner between the vehicle body and the second links.

In the travelling apparatus, the actuator may include a rotation mechanism configured to drive rotation of the second links with respect to the vehicle body.

In the travelling apparatus, the actuator may include a third linear motion mechanism provided in an extendable and retractable manner between the first linear motion mechanisms and the second links.

In the travelling apparatus, a riding seat on which an occupant rides is provided to the vehicle body.

Advantageous Effects of Invention

According to the present invention, it is possible to provide a travelling apparatus that has a simple structure and can be applied to various environments.

DESCRIPTION OF EMBODIMENTS

Hereinafter, exemplary embodiments of a travelling apparatus and a control method for the travelling apparatus according to the present invention will be described in detail based on the drawings. However, the present invention is not limited to the following exemplary embodiments. Further, the following descriptions and drawings are simplified as appropriate for clarity of the descriptions.

First Exemplary Embodiment (Overall structure)

Figure 1:
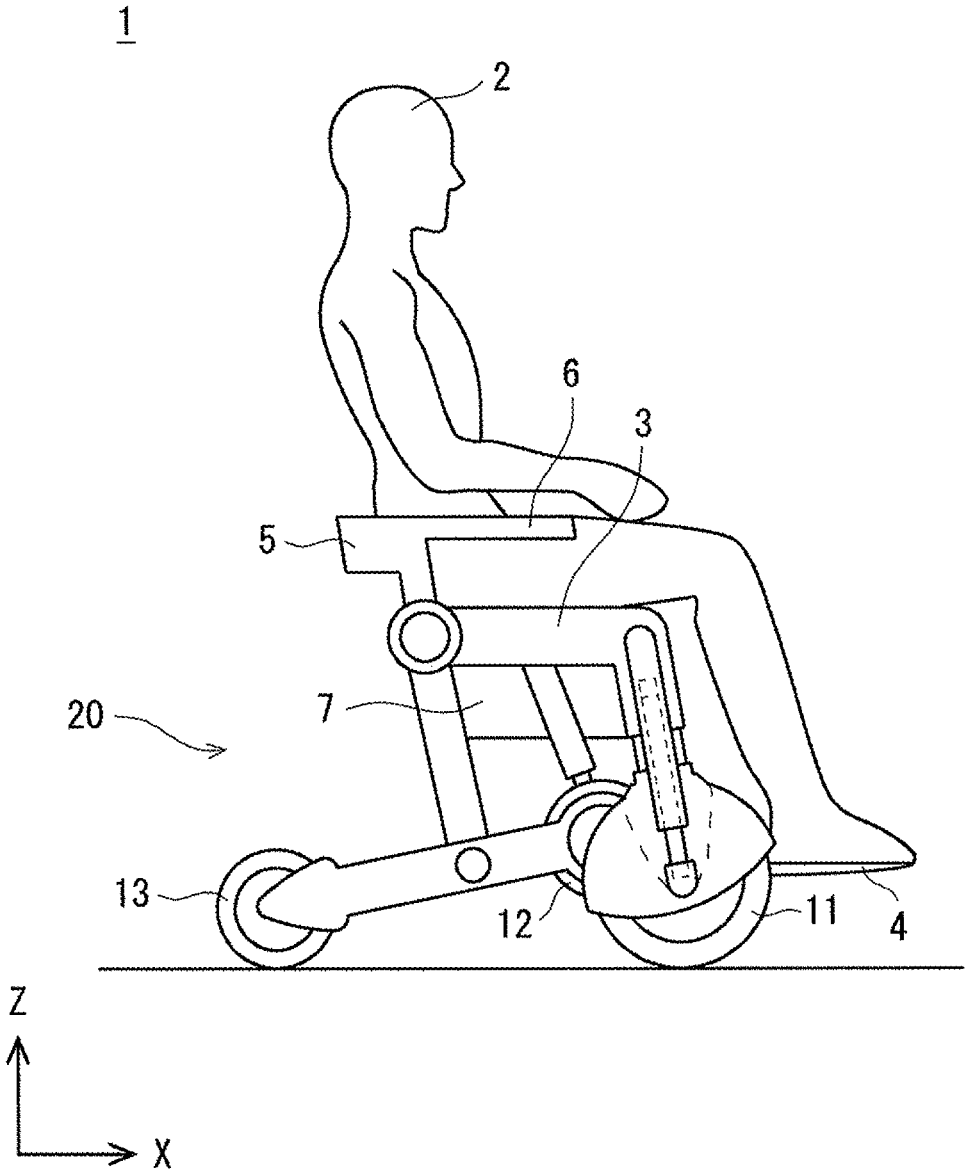
FIG. 1 is a side view showing a structure of a vehicle according to an exemplary embodiment.
Figure 2:
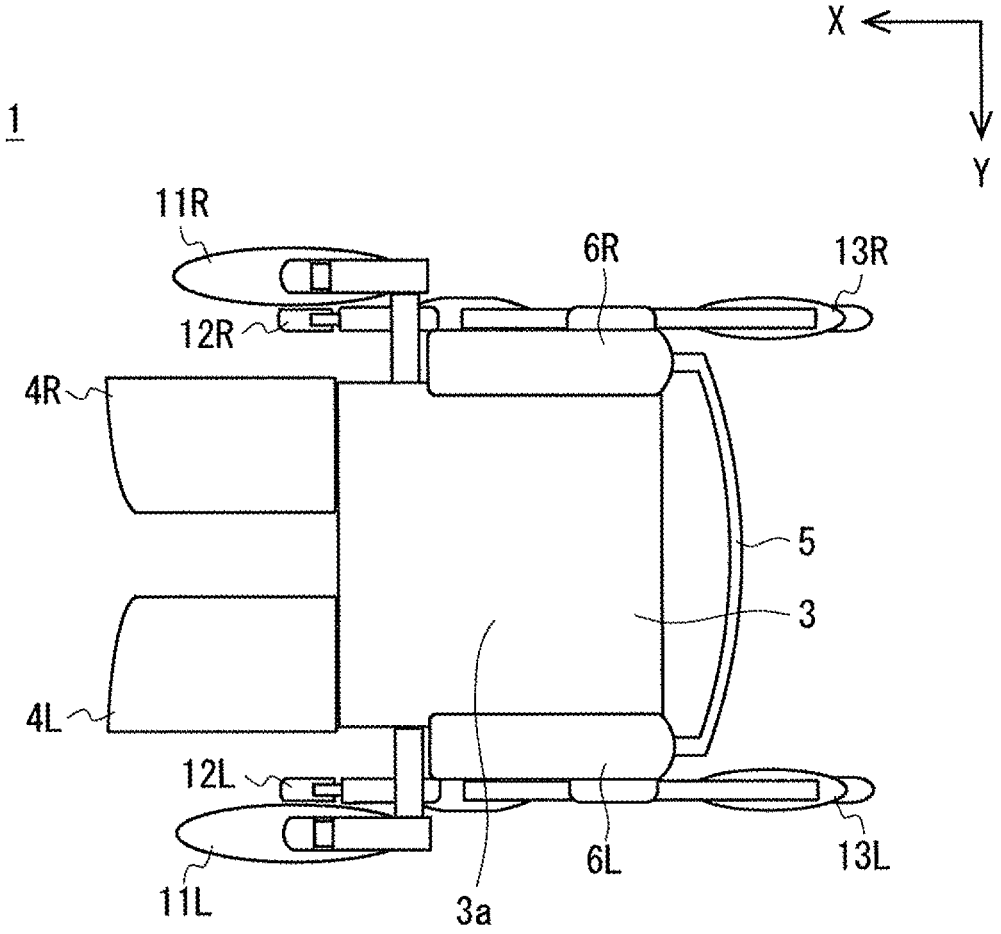
FIG. 2 is a top view showing the structure of the vehicle according to the exemplary embodiment.

A vehicle, which is an example of a travelling apparatus according to this exemplary embodiment, will be described by referring to FIGS. 1 and 2. FIG. 1 is a side view showing a structure of a vehicle 1, and FIG. 2 is a top view showing the structure of the vehicle 1. An XYZ Cartesian coordinate system is used for the description of FIGS. 1 and 2. The +X direction is a front of the vehicle 1, and the −X direction is a back of the vehicle 1. Further, the +Y direction is a left direction of the vehicle 1, and the −Y direction is a right direction of the vehicle 1. The +Z direction is vertically upward, and the −Z direction is vertically downward.

As shown in FIG. 1, the vehicle 1 includes a riding seat 3, footrests 4, a backrest 5, armrests 6, a control box 7, front wheels 11, middle wheels 12, rear wheels 13, and a variable mechanism 20. Note that the vehicle 1 has a symmetric structure and includes the footrests 4, the armrests 6, the front wheels 11, the middle wheels 12, and the rear wheels 13 on both sides of the vehicle 1. Accordingly, in FIG. 2, the footrest 4, the armrest 6, the front wheel 11, the middle wheel 12, and the rear wheel 13 arranged on the left side (on the +Y side) of the vehicle 1 are denoted as a footrest 4L, an armrest 6L, a front wheel 11L, a middle wheel 12L, and a rear wheel 13L, respectively. Likewise, in FIG. 2, the footrest 4, the armrest 6, the front wheel 11, the middle wheel 12, and the rear wheel 13 arranged on the right side (on the −Y side) of the vehicle 1 are denoted as a footrest 4R, an armrest 6R, a front wheel 11R, a middle wheel 12R, and a rear wheel 13R, respectively. In the following descriptions, if there is no clear distinction between the left and right structures, the components will be described without using L and R. The variable mechanism 20 also has a symmetric structure.

The middle wheels 12 are arranged between the front wheels 11 and the rear wheels 13 in the X direction. That is, the front wheels 11 are arranged on the front side (on the +X side) of the middle wheels 12 and the rear wheels 13, and the rear wheels 13 are arranged on the rear side (on the −X side) of the middle wheels 12 and the front wheels 11. The front wheels 11 are driving wheels and rotated when motors or the like are driven. The front wheel 11L and the front wheel 11R are connected to motors different from each other and are independently rotated.

The middle wheels 12 and the rear wheels 13 are trailing wheels and are rotated according to a movement of the vehicle 1. More specifically, when the front wheels 11 are driven and the vehicle 1 is moved, the middle wheels 12 and the rear wheels 13 are rotated following the movement of the vehicle 1.

For example, when the vehicle 1 is moved straight forward, the front wheels 11L and 11R are rotated in the same rotation direction at the same rotation speed. When the vehicle 1 is moved while turning to the left and right, the front wheels 11L and 11R are rotated in the same rotation direction at rotation speeds different from each other. In order to revolve the vehicle 1 on the spot, the front wheels 11L and 11R are rotated in opposite directions at the same rotation speed. As described above, when the left front wheel 11L and the right front wheel 11R are driven by motors different from each other, the vehicle 1 is moved in a desired direction at a desired speed.

The riding seat 3 is a riding part for an occupant 2 to ride on. As shown in FIG. 1, the vehicle 1 is moved while the occupant 2 is sitting on the riding seat 3. The backrest 5, the armrests 6, and the footrests 4 are provided for the riding seat 3. The footrests 4 are arranged at a lower front side of the riding seat 3. In the state in which the occupant 2 is sitting on a seating surface 3*a* of the riding seat 3, a right foot of the occupant 2 is placed on the footrest 4R, and a left foot of the occupant 2 is placed on the footrest 4L.

The armrests 6 are arranged on both sides of the riding seat 3. In the state in which the occupant 2 is sitting on the seating surface 3*a* of the riding seat 3, a right arm of the occupant 2 is placed on the armrest 6R, and a left arm of the occupant 2 is placed on the armrest 6L. The backrest 5 is provided at a rear end of the riding seat 3. In the state in which the occupant 2 is sitting on the seating surface 3*a* of the riding seat 3, the occupant 2 can lean against the backrest 5. That is, a back of the occupant 2 is supported by the backrest.

The variable mechanism 20 is provided under the riding seat 3. The variable mechanism 20 is a leg mechanism that supports the riding seat 3. The front wheels 11, the middle wheels 12, and the rear wheels 13 are rotatably attached to the variable mechanism 20. The variable mechanism 20 includes extendable and retractable arm mechanisms that change a posture of the riding seat 3 with respect to the ground. When the arm mechanisms provided between the wheels and riding seat 3 are extended and retracted, a height and a slope of the seating surface of the riding seat 3 are changed. A specific structure of the variable mechanism 20 will be described later.

The control box 7 is provided just below the riding seat 3. A computer for control, which will be a controller, a battery, and the like are provided in the control box 7.

Figure 3:
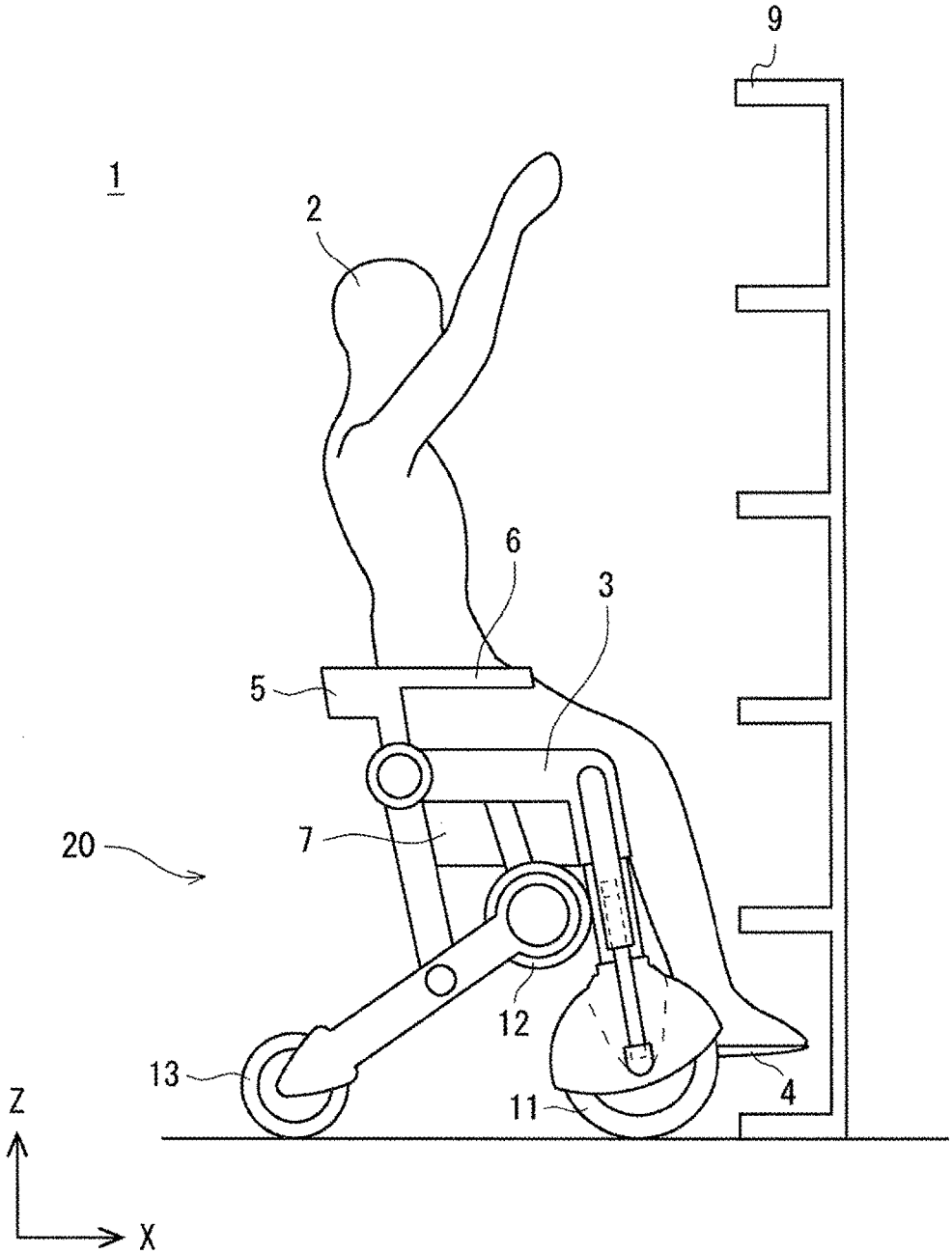
FIG. 3 is a side view showing a state in which a seat height of the vehicle is high.

In a travelling mode shown in FIG. 1, a seat height from the ground is 600 mm. As described above, the variable mechanism 20 changes the height of the riding seat 3. For example, when the variable mechanism 20 increases the height of the riding seat 3, the vehicle 1 will be in the state shown in FIG. 3. In FIG. 3, a standing riding mode in which the seat height of the riding seat 3 is 700 mm is shown. In the standing riding mode shown in FIG. 3, distances between the front wheels 11 and the rear wheels 13 are shorter and the middle wheels 12 are at higher positions than those in the travelling mode shown in FIG. 1. When the height of the riding seat 3 is increased, the occupant 2 can easily access high places. For example, the occupant 2 can easily take goods from a shelf 9. Further, when the occupant 2 moves, his/her eye level will be the same as that of pedestrians. In the travelling mode and standing riding mode, the front wheels 11 and the rear wheels 13 are grounded, and the middle wheels 12 are off the ground, which is a four-wheel grounded mode. Furthermore, when the seat height is increased, the occupant 2 can easily get on and off the vehicle 1.

Figure 4:
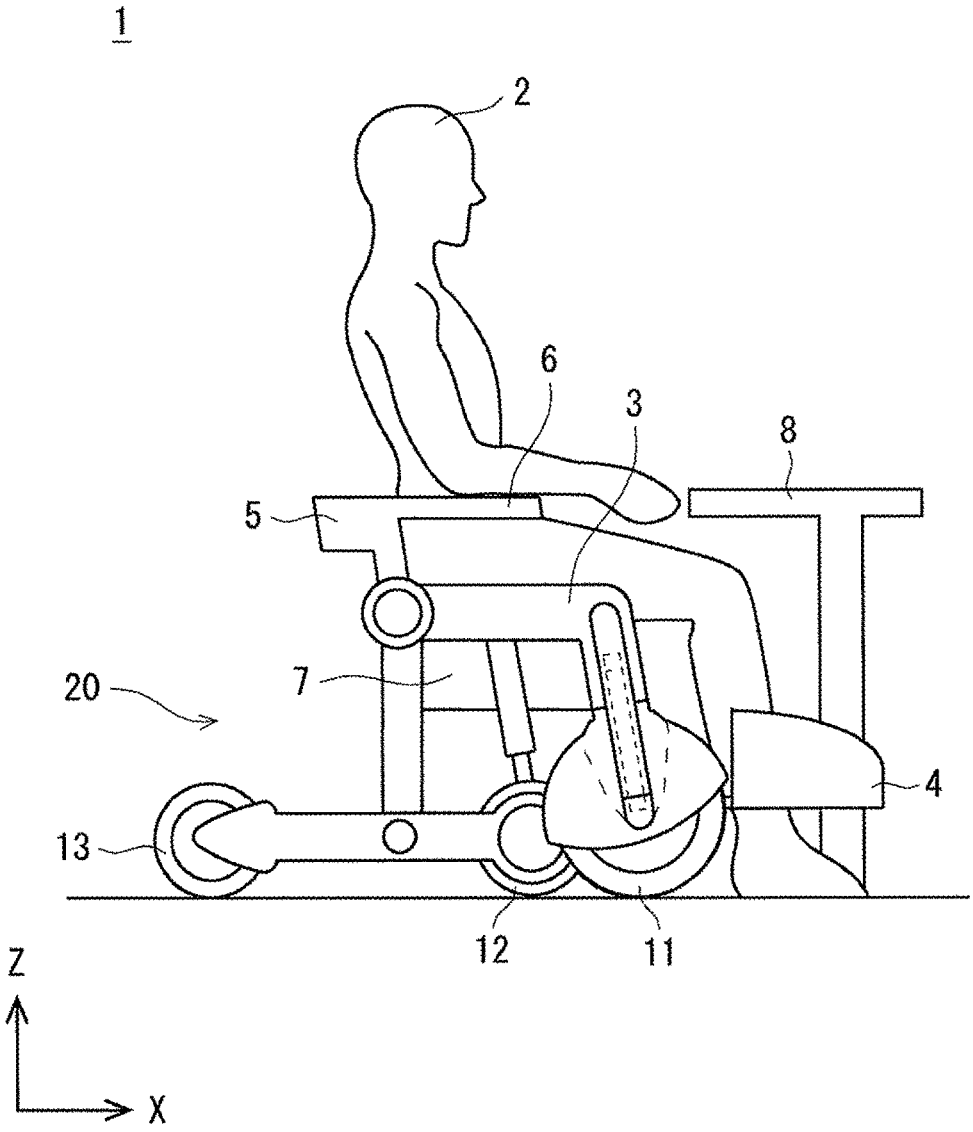
FIG. 4 is a side view showing a state in which the seat height of the vehicle is low.

When the variable mechanism 20 lowers the height of the riding seat 3, the vehicle 1 will be in the state shown in FIG. 4. In FIG. 4, a chair mode in which the seat height of the riding seat 3 is 500 mm is shown. In FIG. 4, the heights of the middle wheels 12 are low and grounded. That is, it will be a six-wheel grounded mode in which all of the front wheels 11, the middle wheels 12, and the rear wheels 13 are grounded.

In the chair mode shown in FIG. 4, distances between the front wheels 11 and the rear wheels 13 are longer than those in the travelling mode shown in FIG. 1. When the height of the riding seat 3 is lowered, the height of the riding seat 3 will become about the same as that of a normal chair. It is thus possible for the vehicle 1 to move under a table 8 while the occupant 2 is riding on the vehicle 1. When motors with brakes are used for the motors of the front wheels 11 and the servos are turned off, the vehicle 1 can be used as a chair. For example, when the occupant 2 moves his or her feet down from the footrests 4, the vehicle 1 is used as a chair. As described above, as the height of the variable mechanism 20 can be changed according to the environment, it is possible to improve the convenience of the vehicle 1. The vehicle 1 can be applied to various usage environments by changing the height of the vehicle 1.

Moreover, as described later, the vehicle 1 can get on or off escalators and climb or go down steps while the occupant is riding on the riding seat 3. Thus, the vehicle 1 can be applied to various environments.

(Structure of Variable Mechanism 20)

Figure 5:
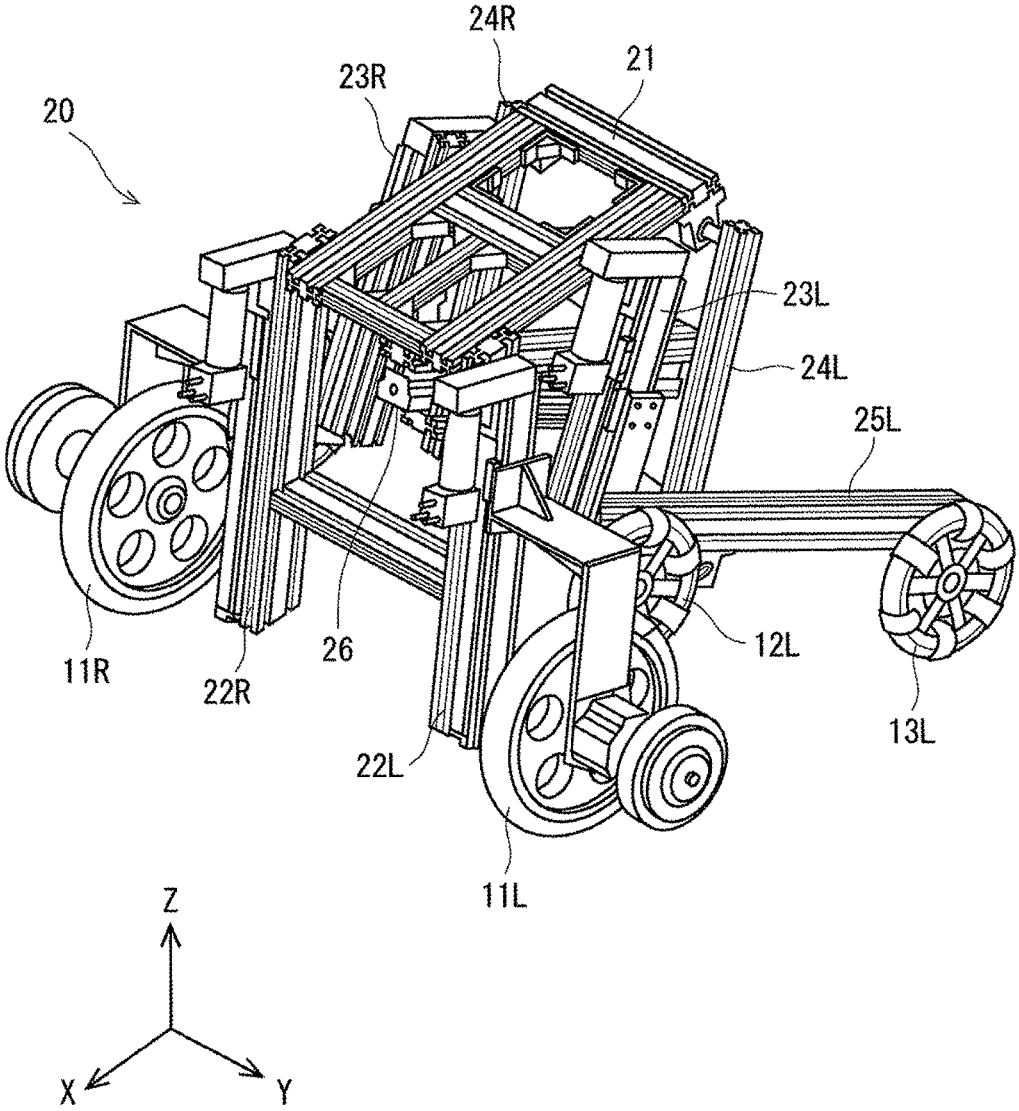
FIG. 5 is a perspective diagram showing a structure of a variable mechanism.
Figure 6:
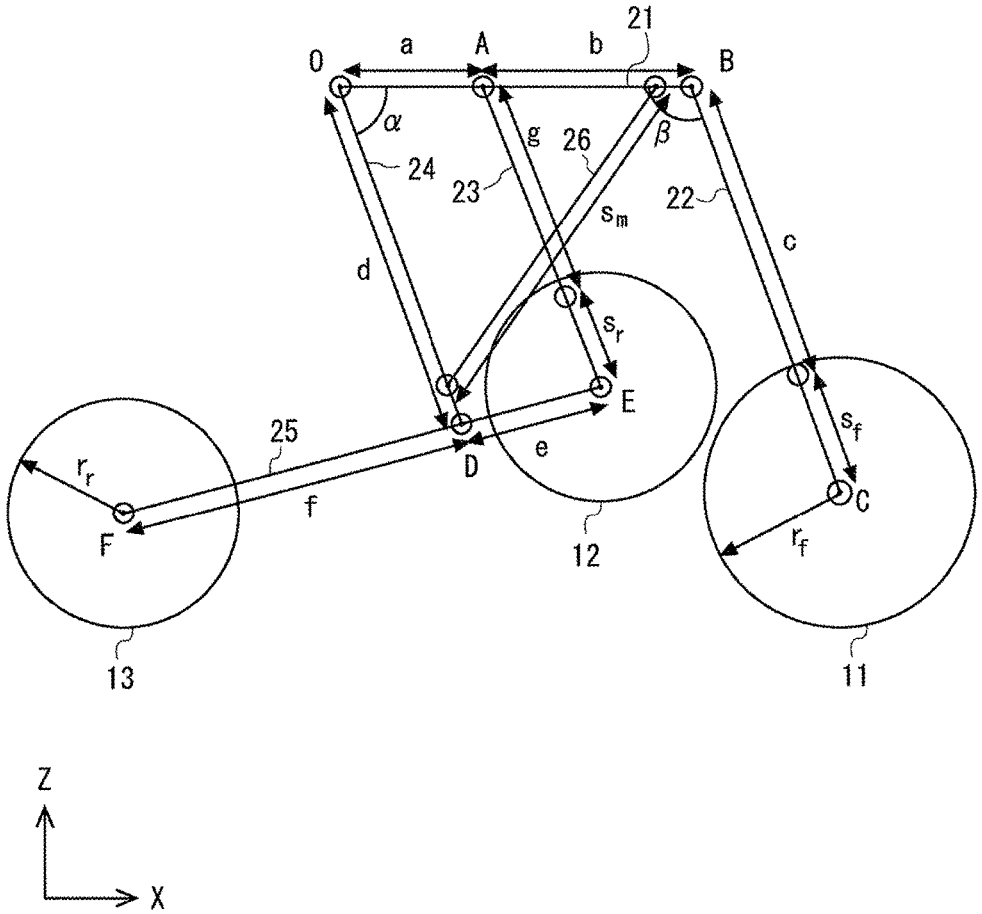
FIG. 6 is a model diagram showing the structure of the variable mechanism.

Next, a structure of the variable mechanism 20 will be described by referring to FIGS. 5 and 6. FIG. 5 is a perspective diagram showing the structure of the variable mechanism 20. FIG. 6 is a model diagram schematically showing the variable mechanism 20. Note that in FIGS. 5 and 6, components such as the riding seat 3 and the like are not shown. The variable mechanism 20 includes an upper frame 21, first linear motion mechanisms 22, second linear motion mechanisms 23, rear links 24, lower links 25, and a third linear motion mechanism 26.

The variable mechanism 20 has a symmetric structure. In a manner similar to the above described one, the symmetric components are denoted by L and R. For example, the variable mechanism 20 includes two first linear motion mechanisms 22L and 22R. The first linear motion mechanisms 22L and 22R are symmetrically arranged. The second linear motion mechanisms 23, the rear links 24, and the lower links 25 are symmetrically arranged in a manner similar to that of the first linear motion mechanisms. In FIG. 5, symmetric components are denoted by L and R, respectively. Further, in FIG. 5, although the lower link 25R, the middle wheel 12R, and the rear wheel 13R are behind other components and not shown as FIG. 5 is a perspective diagram from a certain angle, they are arranged to be symmetric to the lower link 25L, the middle wheel 12L, and the rear wheel 13L, respectively.

The upper frame 21 is disposed at an upper part of the variable mechanism 20. The upper frame 21 constitutes a vehicle body of the vehicle 1. Therefore, the above-mentioned riding seat 3, the control box 7, and the like are attached to the upper frame 21. When the riding seat 3 is attached above the upper frame 21, the riding part is formed. Accordingly, a posture of the upper frame 21 corresponds to a posture of the riding seat 3. When the height of the upper frame 21 is changed, the height of the riding seat 3 is changed, while when an angle of the upper frame 21 is changed, an angle of the riding seat 3 is changed. When the upper frame 21 is tilted forward, the riding seat 3 is also tilted forward. The upper frame 21 has a rectangular frame shape.

The first linear motion mechanisms 22 are attached to both front ends of the upper frame 21. The first linear motion mechanisms 22 are extended obliquely forward and downward from the upper frame 21. The front wheels 11 are attached to lower ends of the first linear motion mechanisms 22. That is, the front wheel 11L is rotatably attached to the first linear motion mechanism 22L, and the front wheel 11R is rotatably attached to the first linear motion mechanism 22R. As mentioned above, the first linear motion mechanisms 22 couple the upper frame 21 and the front wheels 11. An attachment angle $\beta$ between the upper frame 21 and the first linear motion mechanisms 22 is fixed.

The first linear motion mechanism 22 are, for example, extendable and retractable arm mechanisms. That is, the lengths of the first linear motion mechanisms 22 are variable. As shown in FIG. 6, on an XZ plane, a position where the first linear motion mechanism 22 is connected to the upper frame 21 shall be a position B, while a position where the first linear motion mechanism 22 is connected to the front wheel 11 shall be a position C. An axis that passes through the position C and is parallel to a Y-axis shall be a wheel axis of the front wheel 11. The front wheels 11 are rotated around the wheel axes.

The rear links 24 are attached to both rear sides of the upper frame 21. The rear links 24 are extended downward from the upper frame 21. As shown in FIG. 6, on the XZ plane, a position where the upper frame 21 is connected to the rear link 24 shall be a position O. An angle $\alpha$ between the upper frame 21 and the rear link 24 is variable. That is, the upper frame 21 and the rear links 24 are connected to each other with passive joints interposed therebetween, respectively. Accordingly, upper ends of the rear links 24 are rotatably coupled to the upper frame 21. The rear links 24 are rotated around rotation axes that pass through the position O and are parallel to the Y-axis with respect to the upper frame 21.

Lower ends of the rear links 24 are connected to the lower links 25, respectively. The rear links 24 couple the upper frame 21 and the lower links 25. A position where the lower link 25 is connected to the rear link 24 shall be a position D. An angle made by the lower link 25 and the rear link 24 is variable. That is, at the position D, the lower links 25 and the rear links 24 are connected to each other with passive joints interposed therebetween, respectively. The lower links 25 are rotated around rotation axes that pass through the position D and are parallel to the Y-axis with respect to the rear links 24.

The middle wheels 12 are attached to front ends of the lower links 25. The rear wheels 13 are attached to rear ends of the lower links 25. The middle wheel 12R is attached to the front end of the lower link 25R, and the rear wheel 13R is rotatably attached to the rear end of the lower link 25R. Likewise, the middle wheel 12L is rotatably attached to the front end of the lower link 25L, and the rear wheel 13L is rotatably attached to the rear end of the lower link 25L.

A position where the lower link 25 is connected to the middle wheel 12 shall be a position E. A position where the lower link 25 is connected to the rear wheel 13 shall be a position F. Axes that pass through the position E and are parallel to the Y-axis will be wheel axes of the middle wheels 12, and axes that pass through the position F and are parallel to the Y-axis will be wheel axes of the rear wheels 13. The middle wheels 12 and the rear wheels 13 are rotated around the wheel axes, respectively. The lengths of the lower links 25 are fixed. Therefore, distances between the wheel axes of the middle wheels 12 and the wheel axes of the rear wheels 13 are constant. That is, a distance between the positions E and F is constant.

The second linear motion mechanisms 23 are attached to the upper frame 21. Upper ends of the second linear motion mechanisms 23 are each connected to the upper frame 21 at a position A that is between the positions B and O. The second linear motion mechanisms 23 are extended downward from the upper frame 21.

The middle wheels 12 and the lower links 25 are attached to lower ends of the second linear motion mechanisms 23, respectively. That is, the middle wheel 12R is rotatably attached to the second linear motion mechanisms 23R, and the middle wheel 12L is rotatably attached to the second linear motion mechanisms 23L. At the position E, the second linear motion mechanisms 23 are connected to the middle wheels 12 and the lower links 25, respectively. As described above, the second linear motion mechanisms 23 couple the upper frame 21 and the middle wheels 12.

The second linear motion mechanisms 23 are extendable and retractable arm mechanisms. The lengths of the second linear motion mechanisms 23 are variable. Accordingly, distances from the upper frame 21 to the middle wheels 12 are changed. When the second linear motion mechanisms 23 are extended or retracted, angles of the lower links 25 can be changed. Note that angles between the upper frame 21 and the second linear motion mechanisms 23 are variable. That is, at the position A, the upper frame 21 and the second linear motion mechanisms 23 are attached to each other with passive joints interposed therebetween, respectively. The second linear motion mechanisms 23 are rotated around rotation axes that pass through the position A and are parallel to the Y-axis with respect to the upper frame 21.

Angles between the lower links 25 and the second linear motion mechanisms 23 are variable. That is, the lower links 25 and the second linear motion mechanisms 23 are attached to each other with passive joints interposed therebetween, respectively. Accordingly, lower ends of the second linear motion mechanisms 23 are rotatably coupled to front ends of the lower links 25. The lower links 25 are rotated around rotation axes that pass the position E and are parallel to the Y-axis with respect to the second linear motion mechanisms 23.

Further, the third linear motion mechanism 26 is provided between the upper frame 21 and the rear links 24. That is, the third linear motion mechanism 26 couples the upper frame 21 and the rear links 24. An upper end of the third linear motion mechanism 26 is attached to the upper frame 21 at a position between the positions A and B. A lower end of the third linear motion mechanism 26 is attached to the rear links 24 at a position between the positions O and D. An angle made by the third linear motion mechanism 26 and the upper frame 21 is variable. That is, the upper frame 21 and the third linear motion mechanism 26 are attached to each other with a passive joint interposed therebetween. The third linear motion mechanism 26 is rotated around a rotation axis that is parallel to the Y-axis with respect to the upper frame 21.

Moreover, angles made by the third linear motion mechanism 26 and the rear links 24 are variable. That is, the rear links 24 and the third linear motion mechanism 26 are attached to each other with passive joints interposed therebetween, respectively. The third linear motion mechanism 26 is an actuator that changes the angle $\alpha$. The third linear motion mechanism 26 is rotated around a rotation axis that is parallel to the Y-axis with respect to the rear links 24.

As described above, the variable mechanism 20 includes the first linear motion mechanisms 22R and 22L, the second linear motion mechanisms 23R and 23L, and the third linear motion mechanism 26. In summary, the variable mechanism 20 is composed of five-axis linear motion joints. That is, the posture of the vehicle 1 can be changed by five actuators. Therefore, the structure of this exemplary embodiment is simpler than that of Patent Literature 1. The first linear motion mechanisms 22 are front legs, and the second linear motion mechanisms 23 are rear legs. The front wheels 11R and 11L are two-axis driving wheels.

The first linear motion mechanisms 22, the second linear motion mechanisms 23, and the third linear motion mechanism 26 are extendable and retractable link mechanisms. Each of the linear motion mechanisms 22, 23, and 26 includes a driving unit including a motor, a brake, and an encoder, and a link that is extended and retracted by the driving unit. Note that known linear actuators may be used for the linear motion mechanisms. For example, the linear motion mechanism converts a force of a servomotor in the rotation direction into a force in an extending and retracting direction by a ball screw. When a lead of the ball screw is made small, only a small force is required to achieve a large force in a straight direction. In this manner, the linear motion mechanisms will not be pushed by a weight of the occupant 2 to cause the linear motion mechanisms to be retracted, thereby enabling the variable mechanism 20 to maintain its posture. As the linear actuators are used in this exemplary embodiment, the structure of the vehicle 1 can be simplified.

Further, when gas springs are used together with the linear actuators for the linear motion mechanisms, it is possible to reduce loads on the motors. Furthermore, the linear motion mechanisms are not limited to motorized actuators and may instead be hydraulic or pneumatic linear actuators.

As shown in FIG. 6, the lengths of the first linear motion mechanisms 22 are represented by an expression $(c+s_f)$, while the lengths of the second linear mechanisms 23 are represented by an expression $(g+s_r)$. In these expressions, $s_f$ represents a movable distance (a stroke) of the first linear motion mechanisms 22, and $s_r$ represents a movable distance (a stroke) of the second linear motion mechanisms 23. Moreover, $s_m$ represents the length of the third linear motion mechanism 26. Additionally, a distance between the positions O and A is represented by a, and a distance between the positions A and B is represented by b. A distance between the positions O and D, namely, the lengths of the rear links 24, are represented by d. A distance between the positions E and D is represented by e, and a distance between the positions D and F is represented by f. Note that lengths of the lower links 25 are represented by an expression (e+f). The values a to g are fixed values, while the values $s_m$, $s_r$, and $s_f$ are variable values. Further, radii of the front wheels 11 are represented by $r_f$, and radii of the rear wheels 13 are represented by $r_r$. Note that radii of the middle wheels 12 may be the same as the radii $r_r$ of the rear wheels.

Examples of the respective values are shown below. It is obvious that the values in the structure of the variable mechanism 20 are not limited to the following values.

a=160 mm, b=230 mm, c=250 mm, $s_f$=0~390 mm, d=400 mm, e=160 mm, f=390 mm, g=280 mm, $s_r$=0 to 190 mm, $s_m$=260 to 570 mm, α=60 to 110°, β=120° (fixed), $r_f$=150 mm, and $r_r$=100 mm When the first linear motion mechanisms 22 are extended or retracted, the distances between the front wheels 11 and the upper frame 21 are changed. Thus, the height on the front side of the riding seat 3 can be changed. When the second linear motion mechanisms 23 are extended or retracted, the distances between the middle wheels 12 and the upper frame 21 are changed. The first linear motion mechanisms 22R and 22L are driven independently from each other. Likewise, the second linear motion mechanisms 23R and 23L are driven independently from each other. When the third linear motion mechanism 26 is extended or retracted, the angle α is changed. The degree of grounding of the middle wheels 12 and the rear wheels 13 can be changed by the second linear motion mechanisms 23 and the third linear motion mechanism 26. When the second linear motion mechanisms 23 and the third linear motion mechanism 26 are extended or retracted, the angles of the lower links 25 and the rear links 24 are changed. The height from the ground to the position A is also changed. When the third linear motion mechanism 26 is driven in association with the second linear motion mechanisms 23, a pitch angle of the riding seat 3 can be changed.

When the linear motion mechanisms are used for the respective joints, the size of the actuators can be smaller than when rotation mechanisms are used for the respective joints. For example, when the rotation mechanisms are used for the respective joints, a large force is needed to support the weight of the occupant 2. When the force is too small, the variable mechanism 20 is pushed down by the weight of the occupant 2. On the other hand, when the linear motion mechanisms are used for the respective joints, only a small force is needed to support the weight of the occupant 2. It is thus possible to use small actuators.

Note that in the above descriptions, the third linear motion mechanism 26 is composed of one actuator. That is, the third linear motion mechanism 26 is shared by the right and left rear links 24R and 24L. However, the third linear motion mechanism 26 may be independent actuators for the right and left rear links 24R and 24L, respectively. That is, two actuators may be symmetrically attached. In such a case, the angles α may be different from each other on the right and left sides. It is obvious that two linear motion mechanisms that are extended and retracted by the same length may be attached to the right and left rear links 24. In this case, although the number of the actuators is increased, it is possible to control the posture more appropriately.

Note that omni wheels are preferably used for the middle wheels 12 and the rear wheels 13. For example, if swivel casters are used for the middle wheels 12 and the rear wheels 13, as the swivel casters are rotated on a plane, the casters may not be properly rotated in accordance with changes in angles of the lower links 25 with respect to the ground. That is, it is difficult for the wheels to be properly rotated unless the rotation axes of the swivel casters are vertical to the ground. It is thus preferable to always keep the rotation axes of the casters so that they are vertical to the ground. Accordingly, in this exemplary embodiment, omni wheels are used for the middle wheels 12 and the rear wheels 13.

(Modified Example of Variable Mechanism 20)

Figure 7:
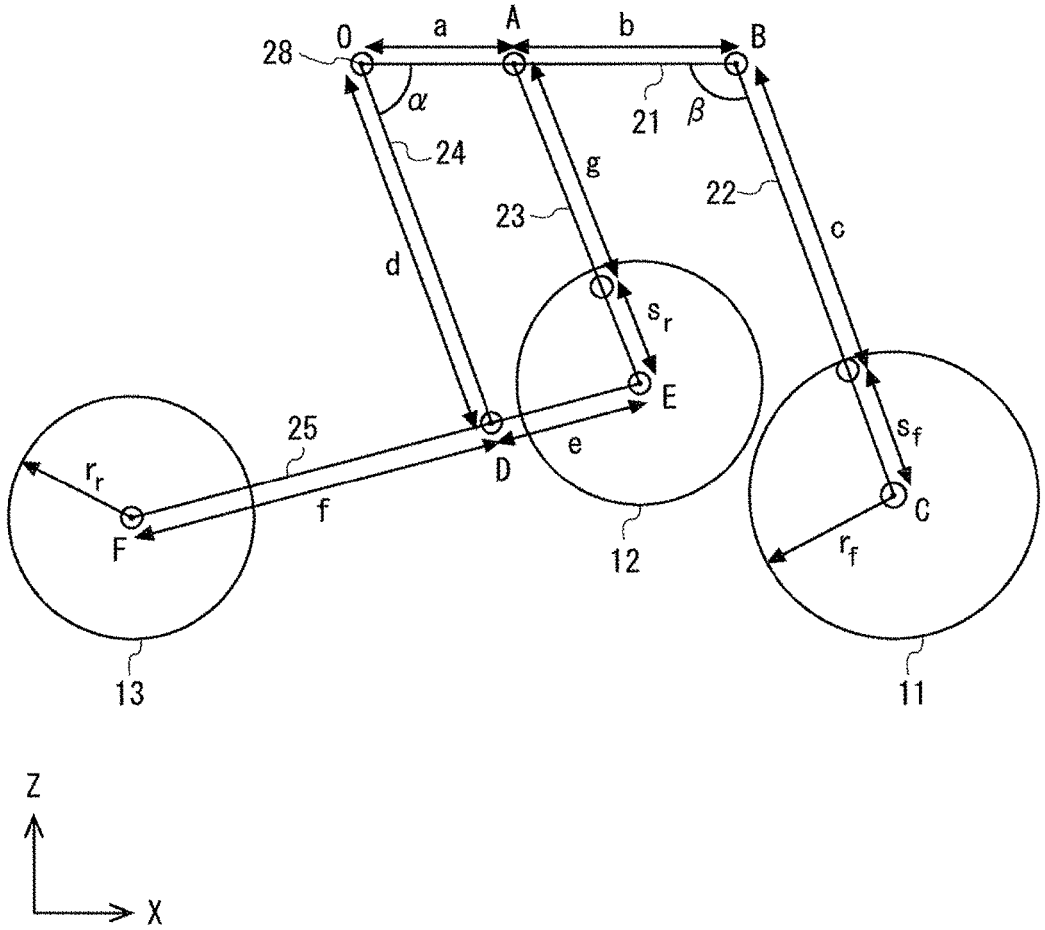
FIG. 7 is a model diagram showing a structure of a variable mechanism according to a modified example.

Note that although the third linear motion mechanism 26 is provided as the actuator for changing the angle α in FIGS. 5 and 6, a rotation mechanism may be used for such an actuator. That is, rotary joints may be used in place of the linear motion joints. A structure example of the variable mechanism 20 using a rotation mechanism is shown in FIG. 7. In FIG. 7, a rotation mechanism 28 for changing the angle α is provided in place of the third linear mechanism 26. In a modified example, an actuator is composed of the rotation mechanism 28 that drives rotations of the rear links 24 with respect to the upper frame 21.

The rotation mechanism 28 is provided at the position O and changes angles of the rear links 24 with respect to the upper frame 21. The rotation axis of the rotation mechanism 28 is parallel to the Y-axis. Note that when the rotary joint is used for the actuator for changing the angle α, by providing independent actuators on both sides, the angles α can be made different from each other on the right and left sides.

Examples of respective values in the modified example are shown below. It is obvious that the values in the structure of the variable mechanism 20 are not limited to the following values.

a=160 mm, b=230 mm, c=250 mm. $s_f$=0 to 390 mm, d=400 mm, e=160 mm, f=390 mm, g=280 mm, $s_r$=0 to 190 mm, α=60 to 110°, β=120° (fixed), $r_f$=150 mm, $r_r$=100 mm (Control System)

Figure 8:
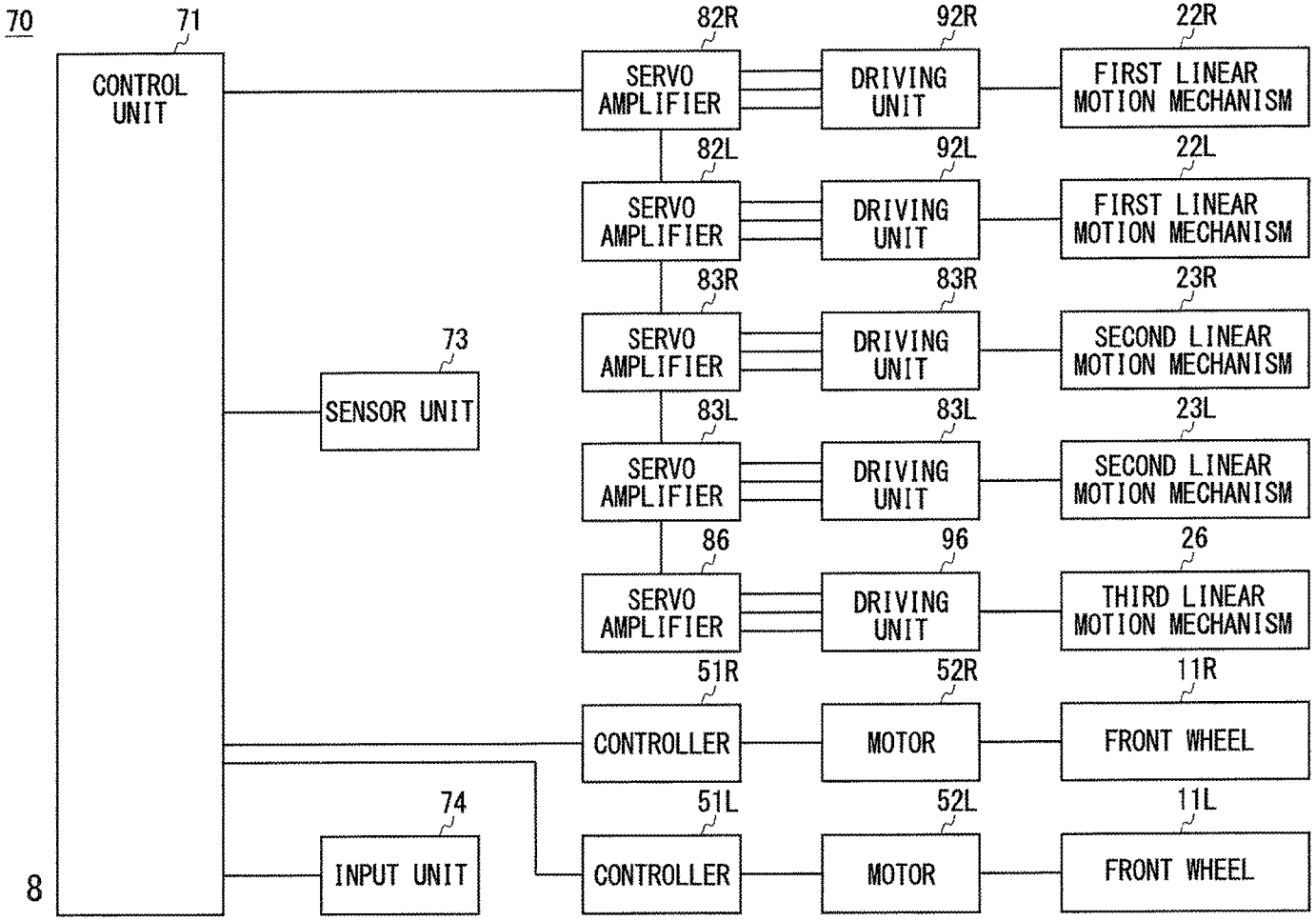
FIG. 8 is a block diagram showing a control system of the vehicle.

A control system of the vehicle 1 according to this exemplary embodiment will be described by referring to FIG. 8. FIG. 8 is a block diagram showing a configuration of a control system 70. The control system 70 includes a control unit 71, a sensor unit 73, and an input unit 74. The control system 70 further includes servo amplifiers 82, 83, and 86, and driving units 92, 93, and 96 in order to control driving of the first linear motion mechanisms 22, the second linear motion mechanisms 23, and the third linear motion mechanism 26, respectively. The control system 70 further includes controllers 51 and motors 52 in order to control driving of the front wheels 11. Note that in a manner similar to the above described one, the components on the right and left sides are denoted by R and L, respectively. A part of the configuration of the control system 70 is accommodated inside, for example, the control box 7.

The input unit 74 is a keyboard, a joypad, or the like and receives inputs regarding a movement direction and a posture of the vehicle 1. For example, the occupant 2 operates the input unit 74 to input the movement direction, the movement speed, or the posture.

The sensor unit 73 is composed of one or a plurality of sensors. The sensor unit 73 includes, for example, an angle sensor that measures the posture of the riding seat 3. To be more specific, the sensor unit 73 includes a six-axis gyro sensor that detects acceleration rates at X-axis, Y-axis, and Z-axis and detects angular speeds around the X-axis, the Y-axis, and the Z-axis. The gyro sensor is installed to become parallel to the seating surface of the riding seat 3. Thus, the gyro sensor detects an inclination angle of the seating surface. The sensor unit 73 further includes various sensors such as a laser range scanner that contactlessly detects a height of a step on a road surface, a camera, or the like.

The control unit 71 is an arithmetic processing unit such as a PC (Personal Computer) including a CPU (Central Processing Unit) and a memory that controls the entire vehicle 1. The control unit 71 outputs control signals to the controllers 51R and 51L and the servo amplifiers 82, 83, and 86 in order to control the front wheels 11.

A part or whole of the above control by the control unit 71 may be executed by a computer program. In this case, the control unit 71 is composed of hardware such as a processor and the like and software stored in a memory or the like. The program executed by the control unit 71 can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

The controllers 51R and 51L are motor controllers that control the motors 52R and 52L, respectively. The motors 52R and 52L have configurations similar to each other and drive the front wheels 11R and 11L, respectively. Thus, the front wheels 11 are rotated in such a way that the vehicle 1 is moved in the movement direction at the movement speed input in the input unit 74. For example, the control unit 71 generates control signals according to input signals input in the input unit 74. The control unit 71 outputs the control signals to the controllers 51. The controllers 51 output command values to the motors 52 according to the control signals. Then, the front wheels 11 connected to the motors 52 are rotated at a desired rotation speed. The motors 52R and 52L drive the front wheels 11R and 11R, respectively, to be rotated independently from each other.

Each of the driving units 92, 93, and 96 includes a servomotor, an encoder, and a brake. The driving units 92, 93, and 96 have configuration similar to one another and drive the first linear motion mechanisms 22, the second linear motion mechanisms 23, and the third linear motion mechanism 26, respectively. The servo amplifiers 82 are amplifiers for controlling driving of the servomotors in the driving units 92, 93, and 96, respectively.

For example, the control unit 71 controls driving of the driving units 92 via the servo amplifiers 82. For example, the control unit 71 outputs control signals to the servo amplifiers 82 in order to move the first linear motion mechanisms 22 to predetermined linear motion axis positions. The servo amplifiers 82 drive the driving units 92 based on the control signals. The encoders in the driving units 92 detect rotation angles of the servomotors. Then, the encoders output the detected rotation angles to the servo amplifiers 82 as feedback signals. The servo amplifiers 82 perform feedback control on the servomotors based on the feedback signals so that the servomotors will have rotation angles according to the control signals. Then, the first linear motion mechanisms 22 are driven to be at the predetermined linear motion axis positions.

Likewise, the control unit 71 controls driving of the driving units 93 and 96 via the servo amplifiers 83 and 86, respectively. Thus, the first linear motion mechanisms 22, the second linear motion mechanisms 23, and the third linear motion mechanism 26 will have predetermined lengths. As described above, the control unit 71 controls the first linear motion mechanisms 22, the second linear motion mechanisms 23, and the third linear motion mechanism 26. In this manner, the variable mechanism 20 can change the posture of the vehicle 1 so that is becomes a desired posture.

(Change in Vehicle Height)

Figure 9:
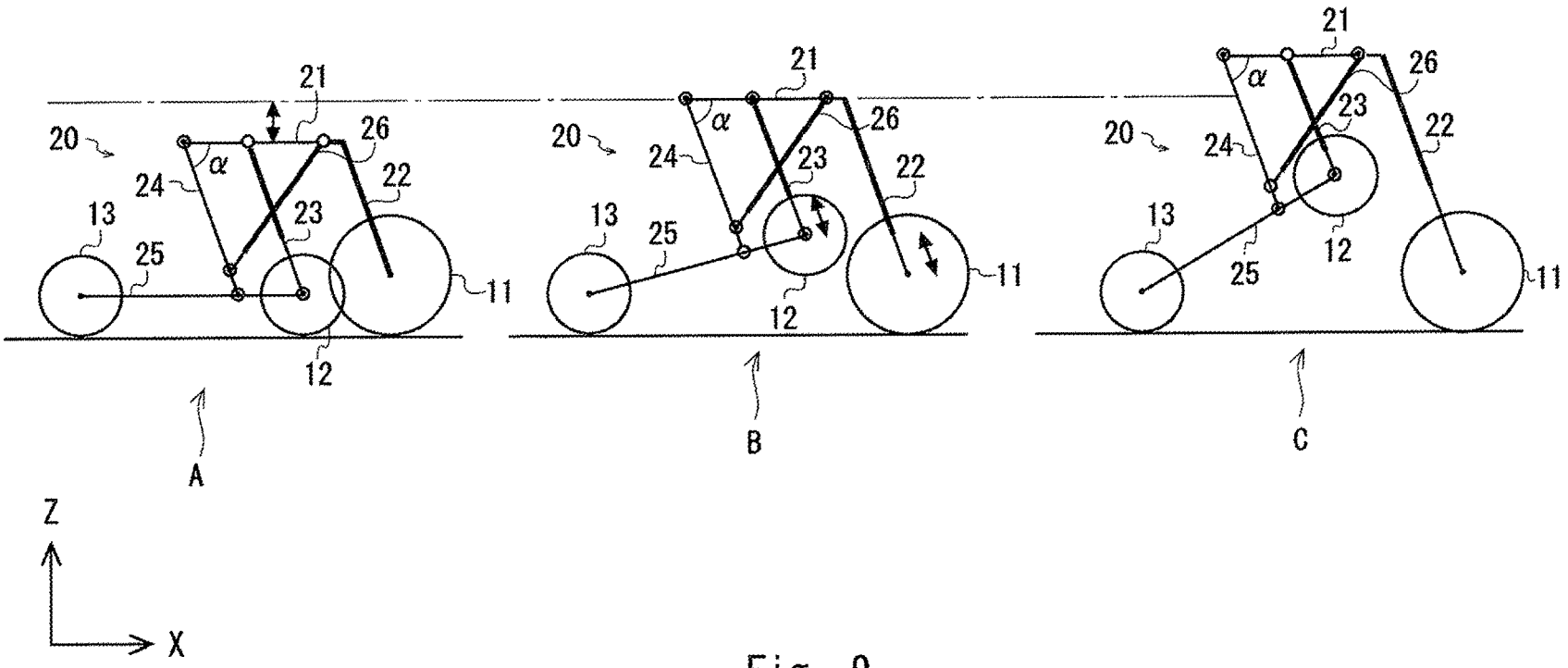
FIG. 9 is a model diagram showing a structure of the variable mechanism in respective modes.

Next, a case in which a height of the vehicle 1 is changed will be described by referring to FIG. 9. FIG. 9 is a model diagram showing the variable mechanism 20. A indicates the state shown in FIG. 4, namely, the chair mode with a low vehicle height. B indicates the state shown in FIG. 1, namely, the travelling mode with a normal vehicle height. C indicates the state shown in FIG. 3, namely, the standing riding mode with a high vehicle height. Note that in FIG. 9, the ground is level.

In the chair mode, the front wheels 11, the middle wheels 12, and the rear wheels 13 are grounded. That is, the lower links 25 are parallel to the ground, and the middle wheels 12 and the rear wheels 13 are in contact with the ground. In the chair mode, $s_f$=33 mm, $s_r$=147 mm, $s_m$=388 mm, and $\alpha$=70°.

In the chair mode, if the first linear motion mechanisms 22 are extended, and the second linear motion mechanisms 23 are retracted, the vehicle 1 will be in the travelling mode. In the travelling mode, $s_f$=139 mm, $s_r$=107 mm, $s_m$=388 mm, and $\alpha$=70°. In this case, as the second linear motion mechanisms 23 are retracted, the lower links 25 are not parallel to the ground, and the middle wheels 12 are off the ground. Note that the front wheels 11 and the rear wheels 13 are grounded.

In the travelling mode, if the first linear motion mechanisms 22 are extended, and the second linear motion mechanisms 23 are retracted, the vehicle 1 will be in the standing riding mode. In the standing riding mode, $s_f$=245 mm, $s_r$=62 mm, $s_m$=388 mm, and $\alpha$=70°. As the second linear motion mechanisms 23 are retracted, inclination angles of the lower links 25 with respect to the ground will become greater. Note the middle wheels 12 are off the ground, and the front wheels 11 and the rear wheels 13 are grounded. When the first linear motion mechanisms 22 are extended, and the second linear motion mechanisms 23 are retracted in the manner described above, the vehicle height will become high.

Note that even when the vehicle height is changed, the length of the third linear motion mechanism 26 has not been changed. That is, in the chair mode, in the travelling mode, and in the standing riding mode, the value of the length of the third linear motion mechanism 26 remains the same. Accordingly, the angle $\alpha$ is fixed at 70° in all the modes. As described above, when the ground is level, the first linear motion mechanisms 22 and the second linear motion mechanisms 23 are driven in association with one another in order to change the vehicle height while the seating surface remains level. That is, when the first linear motion mechanisms 22 and the second linear motion mechanisms 23 are driven without driving the third linear motion mechanism 26, it is possible to change only the vehicle height without changing the angle $\alpha$.

(Handling the Vehicle 1 to Get it on and Off Escalators)

Figure 10:
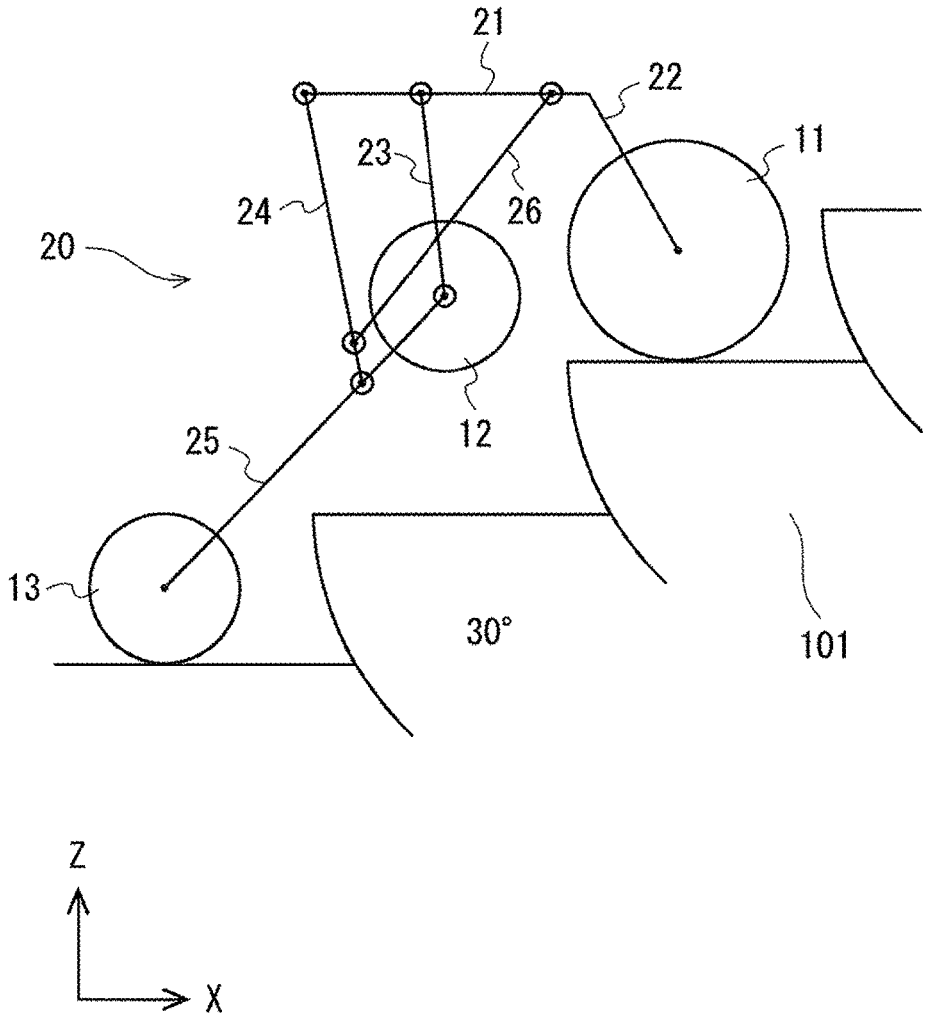
FIG. 10 is a model diagram showing the variable mechanism in a state in which the vehicle is on an up escalator.
Figure 11:
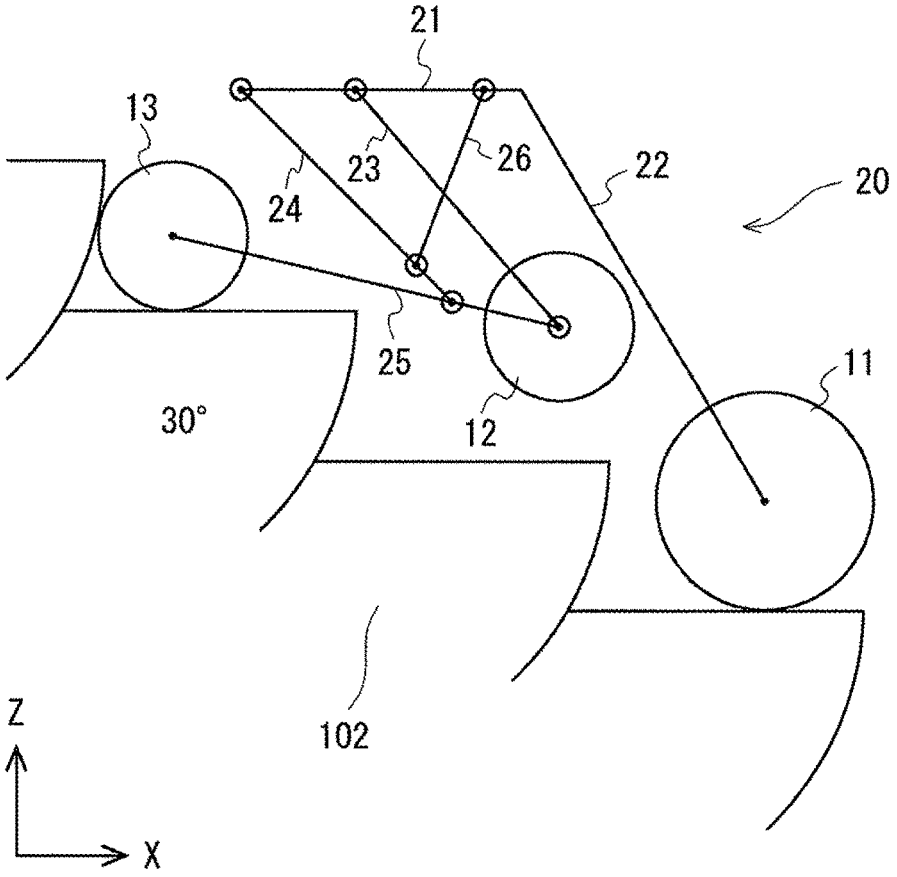
FIG. 11 is a model diagram showing the variable mechanism in a state in which the vehicle is on a down escalator.

Next, handling the vehicle 1 to get it on and off an escalator will be described by referring to FIGS. 10 and 11. FIG. 10 is a drawing showing a state in which the vehicle 1 is on an up escalator, and FIG. 11 is a drawing showing a state in which the vehicle 1 is on a down escalator. Further, in FIGS. 10 and 11, inclination angles of the escalators are 30°.

The case in which the vehicle 1 gets on an up escalator will be described first. When an occupant attempts to get on an up escalator 101 shown in FIG. 10 while travelling in the travelling mode shown in the state B of FIG. 9, firstly the front wheels 11 get on the up escalator 101. When the front wheels 11 get on the up escalator 101, the rotation of the front wheels 11 is stopped, and a brake is put on. Then, the vehicle 1 is moved obliquely upward as the up escalator 101 ascends. The variable mechanism 20 changes the posture of the vehicle 1 according to an inclination of the up escalator 101. For example, the first linear motion mechanisms 22, the second linear motion mechanisms 23, and the third linear motion mechanism 26 are driven in such a way that the upper frame 21 remains level. The variable mechanism 20 changes the posture of the vehicle 1 as the up escalator 101 ascends.

To be more specific, when the vehicle 1 gets on the up escalator 101, the first linear motion mechanisms 22 are retracted, the second linear motion mechanisms 23 are retracted, and the third linear motion mechanism 26 is extended from the travelling mode. Then, the vehicle 1 will be in the state shown in FIG. 10. In this way, the middle wheels 12 are at position higher than the rear wheels 13. As shown in FIG. 10, even when the front wheels 11 are on the two steps above the rear wheels 13, the upper frame 21 can remain almost level because of a great difference between the heights of the middle wheels 12 and the rear wheels 13. That is, even when the inclination angle becomes the one in which the front wheels 11 are on the two steps above the step on which the rear wheels 13 are on, the upper frame 21 will be almost level. As the seating surface becomes almost level, the occupant 2 can get on the up escalator 101 with a posture that is easy for him or her to get on the escalator.

In FIG. 10, the lengths of the first linear motion mechanisms 22 are each 250 mm, namely, $s_f$=0 mm. The lengths of the second linear motion mechanisms 23 are each 280 mm, namely, $s_r$=0 mm. The length of the third linear motion mechanism 26 is $s_m$=430 mm. When the vehicle 1 is on the up escalator 101, the middle wheels 12 are not in contact with the up escalator 101 and four wheels are grounded.

When the vehicle 1 gets on the up escalator 101, firstly the front wheels 11 get on the up escalator 101, and then the rear wheels 13 get on the up escalator 101. From when the front wheels 11 get on the up escalator 101 until the rear wheels 13 get on the up escalator 101, a difference between the heights of the front wheels 11 and the rear wheels 13 will gradually become greater as the up escalator 101 ascends. Accordingly, in this exemplary embodiment, it is preferable to specify linear motion speeds of the first linear motion mechanisms 22, the second linear motion mechanisms 23, and the third linear motion mechanism 26 according to an ascending speed of the up escalator 101 in order to reduce a change in the inclination angle of the upper frame 21 when the vehicle 1 gets on the up escalator 101. That is, the variable mechanism 20 changes the posture of the vehicle 1 in such a way that the change in the inclination angle of the upper frame 21, which the change is caused by ascending of the up escalator 101, is canceled out. For example, the first linear motion mechanisms 22, the second linear motion mechanisms 23, and the third linear motion mechanism 26 are driven according to the pitch angle detected by the gyro sensor. In this way, even when the difference between the heights of the front wheels 11 and the rear wheels 13 is changed, a change in the inclination angle of the riding seat 3 can be reduced, thereby improving ride quality.

Then, the vehicle 1 is moved to an exit of the up escalator 101 in the state shown in FIG. 10. The difference between the heights of the front wheels 11 and the rear wheels 13 will become gradually small as the up escalator 101 ascends immediately before the vehicle 1 gets off the up escalator 101. The vehicle 1 is returned from the state shown in FIG. 10 to the travelling mode shown in FIG. 9. When the vehicle 1 gets off the up escalator 101, the first linear motion mechanisms 22 are extended, the second linear motion mechanisms 23 are extended, and the third linear motion mechanism 26 is retracted. Then, the vehicle 1 is returned to the travelling mode shown in FIG. 9. When the step on which the front wheels 11 ride ascends to the highest position of the up escalator 101, the front wheels 11 are rotated, so that the vehicle 1 is moved forward. By doing so, the vehicle 1 can get off the up escalator 101.

Note that the difference between the heights of the front wheels 11 and the rear wheels 13 is gradually changed also when the vehicle 1 gets off the up escalator 101. Accordingly, in this exemplary embodiment, it is preferable to specify the linear motion speeds of the first linear motion mechanisms 22, the second linear motion mechanisms 23, and the third linear motion mechanism 26 according to the ascending speed of the up escalator 101 in order to reduce a change in the inclination angle of the upper frame 21 when the vehicle 1 gets off the up escalator 101. That is, the variable mechanism 20 changes the posture of the vehicle 1 in such a way that the change in the inclination angle of the upper frame 21 is canceled out, in which the change is caused by ascending of the up escalator 101. For example, the first linear motion mechanisms 22, the second linear motion mechanisms 23, and the third linear motion mechanism 26 are driven according to the pitch angle detected by the gyro sensor. In this way, even when the difference between the heights of the front wheels 11 and the rear wheels 13 is changed, a change in the inclination angle of the riding seat 3 can be reduced, thereby improving ride quality.

Next, a case in which the vehicle 1 gets on a down escalator will be described. When an occupant attempts to get on a down escalator 102 shown in FIG. 11 while travelling in the travelling mode shown FIG. 9, firstly the front wheels 11 get on the down escalator 102. When the front wheels 11 ride on the down escalator 102, the rotation of the front wheels 11 is stopped, and a brake is put on. Then, the vehicle 1 is moved obliquely downward as the down escalator 102 descends. The variable mechanism 20 changes the posture of the vehicle 1 according to an inclination of the down escalator 102. For example, the first linear motion mechanisms 22, the second linear motion mechanisms 23, and the third linear motion mechanism 26 are driven in such a way that the upper frame 21 remains level. The variable mechanism 20 changes the posture of the vehicle 1 as the down escalator 102 ascends.

To be more specific, when the vehicle 1 gets on the down escalator 102, as shown in FIG. 11, the first linear motion mechanisms 22 are extended, the second linear motion mechanisms 23 are extended, and the third linear motion mechanism 26 is retracted. As the third linear motion mechanism 26 is retracted, the angle $\alpha$ will become small. The middle wheels 12 are moved at positions lower than the rear wheels 13. Accordingly, as shown in FIG. 11, even when the front wheels 11 ride on a step two steps below a step on which the rear wheels 13 ride, the upper frame 21 can remain almost level. That is, even when the inclination angle will become the one in which the front wheels 11 are on the two steps below the step on which the rear wheels 13 are on, the upper frame 21 will be almost level. In this way, the occupant 2 can get on the down escalator 102 with a posture that is easy for him or her to get on the down escalator 102.

In FIG. 11, the lengths of the first linear motion mechanism 22 are 640 mm, namely, $s_f$=390 mm. The lengths of the second linear motion mechanism 23 are 424 mm, namely, $s_r$=144 mm. The length of the third linear motion mechanism 26 is $s_m$=260 mm. When the vehicle 1 rides on the down escalator, the middle wheels 12 are not in contact with the down escalator 102.

Then, the vehicle 1 is moved to an exit of the down escalator 102 in the state shown in FIG. 11. The difference between the heights of the front wheels 11 and the rear wheels 13 will become gradually small as the down escalator 102 descends immediately before the vehicle 1 gets off the down escalator 102. The vehicle 1 is returned to the travelling mode shown in the state B of FIG. 9 from the state shown in FIG. 11. When the vehicle 1 gets off the down escalator 102, the first linear motion mechanisms 22 are retracted, the second linear motion mechanisms 23 are retracted, and the third linear motion mechanism 26 is extended. Then, the vehicle 1 is returned to the travelling mode. That is, the vehicle 1 is returned to the state B of FIG. 9. When the step on which the front wheels 11 ride descends to the lowest position of the down escalator 102, the front wheels 11 are rotated, so that the vehicle 1 is moved forward. By doing so, the vehicle 1 can get off the down escalator 102.

Note that in a manner similar to the case in which the vehicle 1 gets on and off the up escalator 101, the difference between the heights of the front wheels 11 and the rear wheels 13 is changed when the vehicle 1 gets on and off the down escalator 102. Accordingly, it is preferable to specify linear motion speeds of the first linear motion mechanisms 22, the second linear motion mechanisms 23, and the third linear motion mechanism 26 according to a descending speed of the down escalator 102 in order to reduce a change in the inclination angle of the riding seat 3. That is, the variable mechanism 20 changes the posture of the vehicle 1 in such a way that the change in the inclination angle of the upper frame 21 is canceled out, in which the change is caused by descending of the down escalator. For example, the first linear motion mechanisms 22, the second linear motion mechanisms 23, and the third linear motion mechanism 26 are driven according to the pitch angle detected by the gyro sensor. In this way, even when the difference between the heights of the front wheels 11 and the rear wheels 13 is changed, a change in the inclination angle of the riding seat 3 can be reduced, thereby improving ride quality.

As described above, the vehicle 1 can get on and off the up escalator 101 and the down escalator 102. It is thus possible for the vehicle 1 to be adapted to various environments. When the variable mechanism 20 has the above dimensions, the vehicle 1 can get on and off escalators each having an inclination angle up to 30°. The vehicle 1 can be adapted to escalators having a maximum inclination angle of 35° on specification by changing the above dimension structure.

(Handling the Vehicle 1 to Climb and Goes Down Steps)

Figure 12:
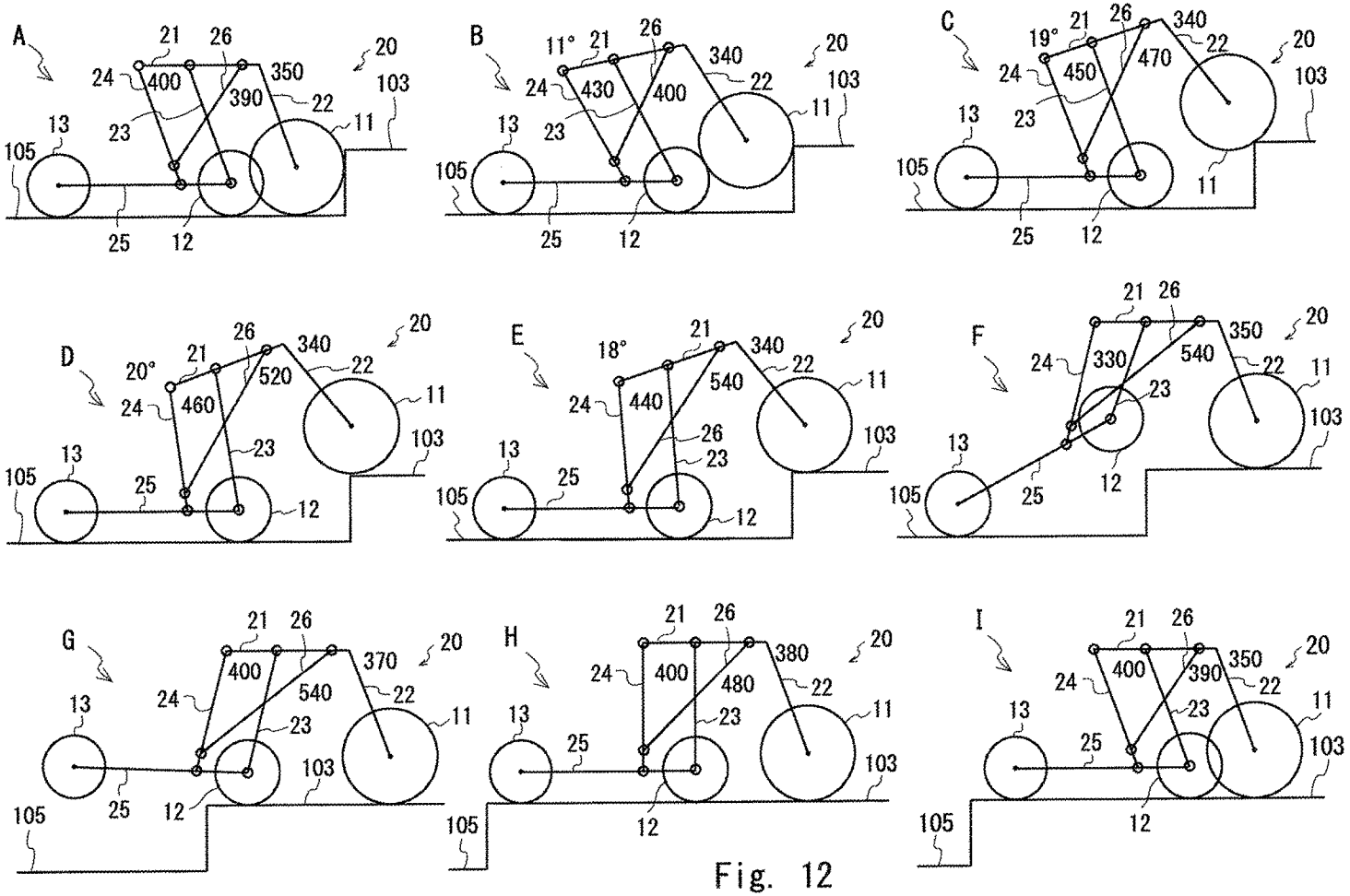
FIG. 12 is a model diagram showing the structure of the variable mechanism when the vehicle climbs a step.
Figure 13:
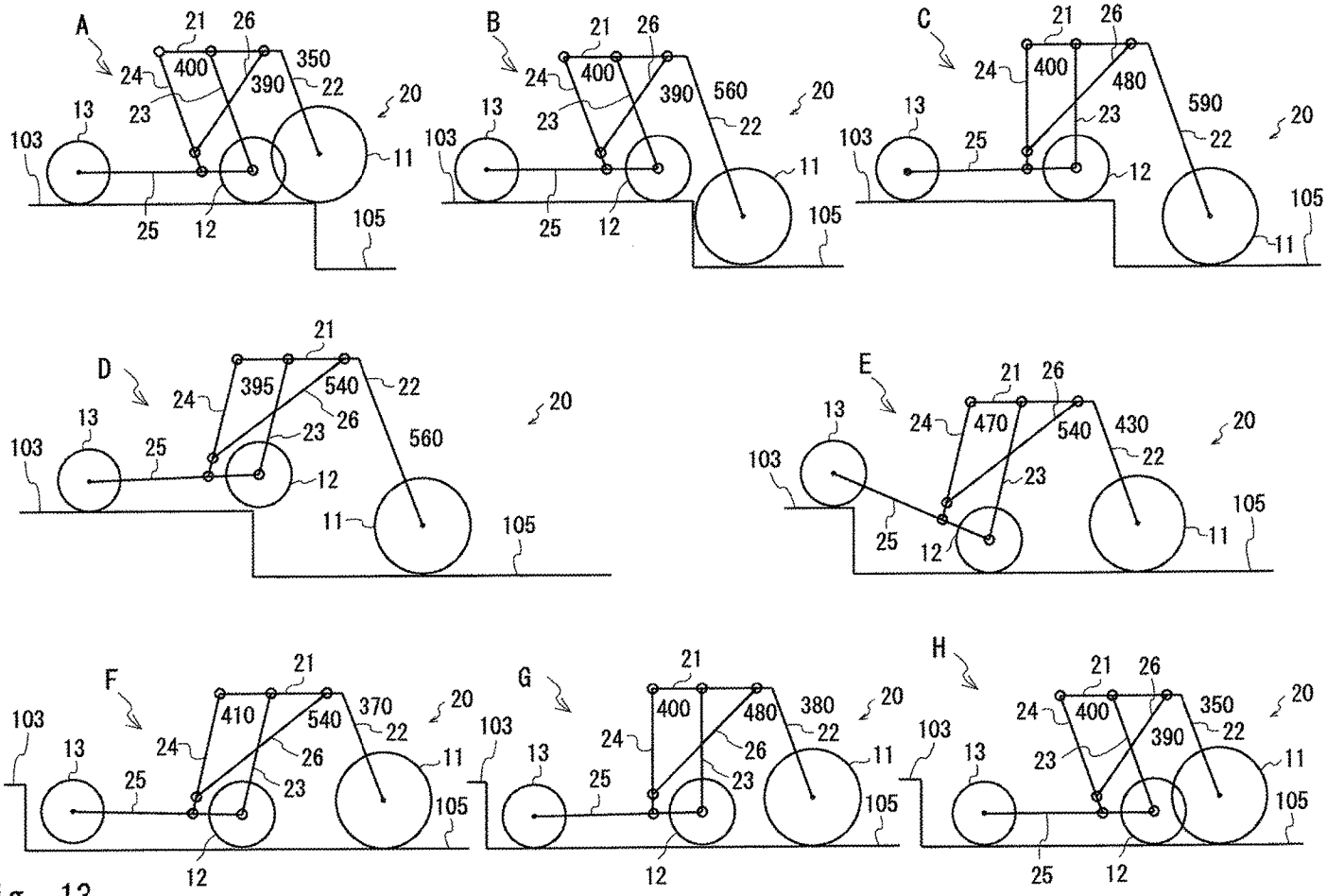
FIG. 13 is a model diagram showing the structure of the variable mechanism when the vehicle goes down a step.

Next, an operation of the variable mechanism 20 when the vehicle 1 climbs and goes down steps will be described. FIG. 12 is a model diagram showing an operation of the variable mechanism 20 when the vehicle 1 goes over a step 103. FIG. 13 is a model diagram showing an operation of the variable mechanism 20 when the vehicle 1 goes down the step 103. In FIGS. 12 and 13, the step 103 is present on a level floor surface 105. Further, a top surface of the step 103 is also level. In FIGS. 12 and 13, lengths of the respective linear motion mechanisms are shown.

Firstly, a case in which the vehicle 1 moving on the flat floor surface 105 climbs the step 103 will be described. When the vehicle 1 climbs the step 103, the state of the variable mechanism 20 is changed in the order of timings A to I in FIG. 12. Firstly, when the vehicle 1 is travelling in the travelling mode and comes closer to the step 103, the vehicle 1 is changed to the chair mode. Then, when the vehicle 1 is travelling on the floor surface 105 in the chair mode, the front wheels 11 abut on a side surface of the step 103 (timing A). The first linear motion mechanisms 22 are retracted, the second linear motion mechanisms 23 are extended, and the third linear motion mechanism 26 is extended. By doing so, as shown in the timing B, the front wheels 11 are lifted and taken off the floor surface 105. That is, the upper frame 21 is tilted backward by 11° and is lifted in the state where the front wheels 11 are in contact with the side surface of the step 103. Note that the timing when the front wheels 11 are lifted may be before the front wheels 11 are brought into contact with the step 103.

In the state shown in the timing B, the second linear motion mechanisms 23 are further extended, and the third linear motion mechanism 26 is further extended. By doing so, as shown in the timing C, the front wheels 11 are lifted up to the height of the step 103. That is, the front wheels 11 are lifted to near the top surface of the step 103. In the state shown in the timing C, the upper frame 21 is tilted backward by 19°.

In the state shown in the timing C, when the upper frame 21 is tilted further backward, the vehicle 1 will be in the state shown in the timing D. In the state shown in the timing D, the lengths of the second linear motion mechanisms 23 and the third linear motion mechanism 26 are longer than those in the state shown in the timing C. Then, the front wheels 11 ride over the step 103. That is, the front wheels 11 are moved above the step 103. In the state shown in the timing D, the upper frame 21 is tilted backward by 20°.

In the state shown in the timing D, when the forward inclination angle of the upper frame 21 is reduced, the vehicle 1 will be in the state shown in the timing E. In the state shown in the timing E, the second linear motion mechanisms 23 are retracted, and the third linear motion mechanism 26 is extended from the state shown in the timing D. In the state shown in the timing E, the upper frame 21 is tilted backward by 18°. In the state shown in the timing E, as the front wheels 11 are grounded on the step 103, the vehicle 1 can be moved forward by the rotation of the front wheels 11.

Note that in the timings A to E, the posture of the vehicle 1 is changed while the middle wheels 12 and the rear wheels 13 are grounded. While the front wheels 11 are off the ground, the middle wheels 12 and the rear wheels 13 are grounded. The vehicle 1 can be stabilized in this way. In the timings A to E, the variable mechanism 20 operates in such a way that the posture of the vehicle 1 is changed while the lower links 25 remain level.

When the vehicle 1 is moved forward by the rotation of the front wheels 11 from the state shown in the timing E, and the middle wheels 12 are brought closer to the step 103, the vehicle 1 will be in the state shown in the timing F. In this example, the first linear motion mechanisms 22 and the second linear motion mechanism 23 are driven in such a way that the middle wheels 12 are lifted at the same time as the vehicle 1 is moved forward. To be more specific, the first linear motion mechanisms 22 are extended, and the second linear motion mechanisms 23 are retracted. When the second linear motion mechanisms 23 are retracted, the middle wheels 12 are lifted and taken off the floor surface 105. In the state shown in the timing E, the upper frame 21 becomes level.

When the vehicle 1 is moved further forward from the state shown in the timing F, the middle wheels 12 are moved above the step 103. When the middle wheels 12 are moved above the step 103, the first linear motion mechanisms 22 and the second linear motion mechanisms 23 are driven in such a way that the middle wheels 12 are lowered and the rear wheels 13 are lifted. To be more specific, the first linear motion mechanisms 22 are extended, and the second linear motion mechanisms 23 are extended. By doing so, the middle wheels 12 are lowered and brought into contact with the step 103. The front wheels 11 and the middle wheels 12 ride on the step 103. In the state shown in the timing G, the upper frame 21 becomes level. Further, in the state shown in the timing G, the lower links 25 are tilted, and the rear wheels 13 are higher than the middle wheels 12. In the timings E to G, the length of the third linear motion mechanism 26 is fixed at 540 mm.

In the state shown in the timing G, when the vehicle 1 is moved forward by rotating the front wheels 11, the rear wheels 13 are moved above the step 103. At this time, when the first linear motion mechanisms 22 are extended, and the third linear motion mechanism 26 is retracted, the vehicle 1 will be in the state shown in the timing H. In the state shown in the timing H, the lower links 25 are level, and the rear wheels 13 are grounded. In the state shown in the timing H, as the angle $\alpha$ is nearly a right angle, the vehicle height is higher than the state shown in the timing G.

Then, when the first linear motion mechanisms 22 are retracted, and the third linear motion mechanism 26 is extended in order to return the vehicle 1 to the chair mode, the vehicle 1 will be in the state shown in the timing I. The variable mechanism 20 in the state shown in the timing I is in the same state as the state shown in the timing A. By performing control in this manner, the vehicle 1 can climb the step 103. When the vehicle 1 finished climbing the step 103, the vehicle 1 is changed from the chair mode to the travelling mode. Thus, the vehicle 1 can travel on the step 103 in the travelling mode.

Next, a case in which the vehicle 1 moving on the step 103 goes down the step 103 will be described. When the vehicle 1 goes down the step 103, the state of the variable mechanism 20 is changed in the order of timings A to H in FIG. 13. Firstly, when the vehicle 1 is brought closer to an edge of the step 103 while travelling on the step 103 in the travelling mode, the vehicle 1 is switched to the chair mode. Then, the front wheels 11 of the vehicle 1 in the chair mode are moved (timing A). When the front wheels 11 get over the edge of the step 103, as shown in the timing B, the first linear motion mechanisms 22 are extended, and the front wheels 11 are grounded on the floor surface 105. In the state shown in the timing B, the lower links 25 are parallel to the upper surface of the step 103, and the middle wheels 12 and the rear wheels 13 are grounded.

When the vehicle 1 is moved forward, the front wheels 11 are taken off the step 103 as shown in the timing C. In this example, the first linear motion mechanisms 22 are extended, and the third linear motion mechanism 26 is extended. Then, the front wheels 11 are brought into contact with the floor surface 105, and the middle wheels 12 and the rear wheels 13 are in contact with the step 103, which is a six-wheel grounded state.

When the vehicle 1 is moved further forward, the variable mechanism 20 operates in such a way that the middle wheels 12 are taken off the upper surface of the step 103, as shown in the timing D. To be more specific, the first linear motion mechanisms 22 are retracted, the second linear motion mechanisms 23 are retracted, and the third linear motion mechanism 26 is extended. When the second linear motion mechanisms 23 are retracted, the middle wheels 12 are taken off the step 103. That is, the lower links 25 are tilted backward in such a way that the middle wheels 12 will be higher than the rear wheels 13. Then, the front wheels 11 are brought into contact with the floor surface 105, the middle wheels 12 are taken off the step 103, and the rear wheels 13 are brought into contact with the step 103, which is a four-wheel grounded state.

When the middle wheels 12 are lowered to be in contact with the floor surface 105 while the vehicle 1 is further moved forward, the vehicle 1 will be in the state shown in the timing E. In this example, the first linear motion mechanisms 22 are retracted, and the second linear motion mechanisms 23 are extended. Then, the lower links 25 are tilted forward, and the middle wheels 12 are moved to be lower than the rear wheels 13. The middle wheels 12 go down the step 103 and are brought into contact with the floor surface 105. At this time, the rear wheels 13 are in contact with the top surface of the step 103. Then, the front wheels 11 and the middle wheels 12 are brought into contact with the floor surface 105, and the rear wheels 13 are in contact with the step 103, which is a six-wheel grounded state.

When the rear wheels 13 are lowered while the vehicle 1 is further moved, the vehicle 1 will be in the state shown in the timing F. In this example, the first linear motion mechanisms 22 are retracted, and the second linear motion mechanisms 23 are retracted. Then, the lower links 25 go down the step 103, and the rear wheels 13 are brought closer to the floor surface 105, as shown in the timing F.

Further, when the lower links 25 are made parallel to the floor surface 105, the vehicle 1 will be in the state shown in the timing G. In this example, the first linear motion mechanisms 22 are extended, the second linear motion mechanisms 23 are retracted, and the third linear motion mechanism 26 is retracted. Then, the rear wheels 13 are also brought into contact with the floor surface 105, and it will be a six-wheel grounded state. That is, the lower links 25 are parallel to the floor surface 105.

When the vehicle 1 is returned to the chair mode, the vehicle 1 will be in the state shown in the timing H. In this example, the first linear motion mechanisms 22 are retracted, and the third linear motion mechanism 26 is retracted. In this way, the vehicle 1 is returned to the chair mode. As described above, the vehicle 1 can go down steps while the upper frame 21 remains almost level. Therefore, ride quality can be improved. When the vehicle 1 finishes going down the step 103, the vehicle 1 is switched from the chair mode to the travelling mode, and then the vehicle 1 travels.

As described above, the vehicle 1 can climb and go down the step 103. It is thus possible for the vehicle 1 to be adapted to various environments. The ride quality can be improved also when the vehicle 1 climbs and goes down steps.

Additionally, the vehicle 1 can climb and goes down steps at places where steps and gaps are present, for example, a place between train and platform. That is, the vehicle 1 can climb and goes down steps while getting over gaps. Accordingly, the vehicle 1 can get on and off trains and buses.

Note that in the state where only the middle wheels 12 and the rear wheels 13 are grounded, if the road surface is inclined forward, backward, to the right, or to the left, the vehicle 1 may be moved in the inclined direction. That is, as the front wheels 11, which are driving wheels, are not grounded, the vehicle 1 may go down the inclination. For this reason, in the state where only the middle wheels 12 and the rear wheels 14, which are trailing wheels, are grounded, it is preferable to put a brake on at least one of the middle wheels 12 and the rear wheels 13.

(Handling Ground Inclined to the Sides)

Figure 14:
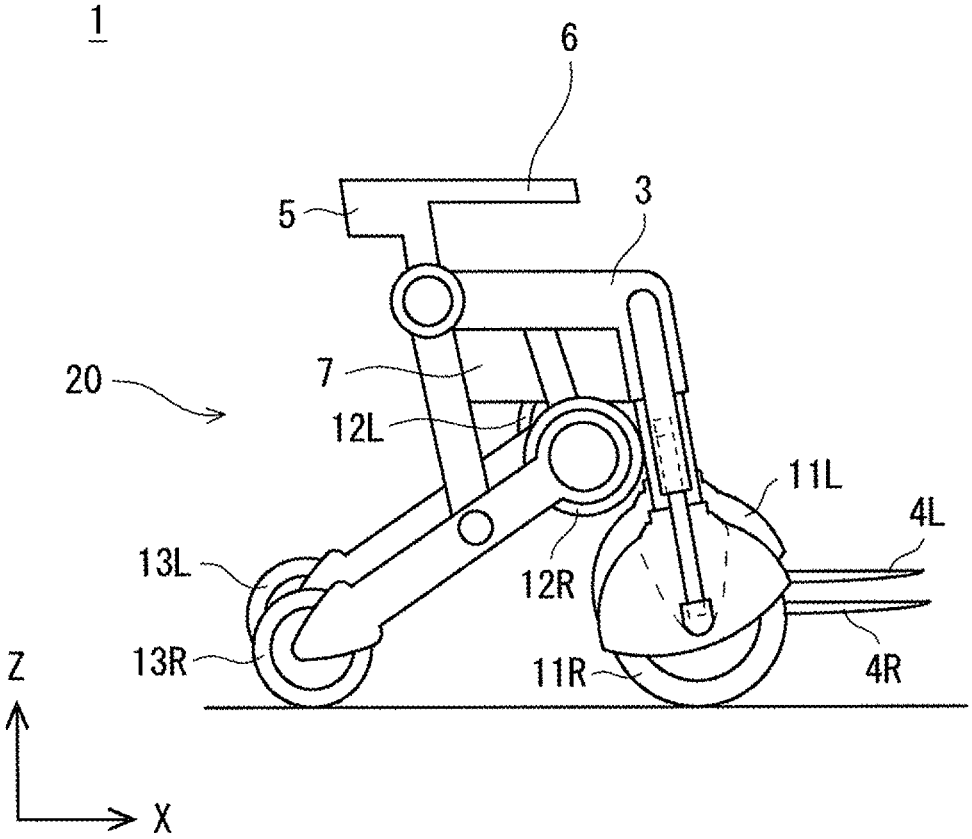
FIG. 14 is a model diagram showing the vehicle when the vehicle is moved on a slope.

Next, a case when the vehicle 1 is moved on a ground inclined to the right or left will be described by referring to FIG. 14. FIG. 14 is a side view showing a state in which the vehicle 1 is moved on a ground inclined upward to the left. When the vehicle 1 is moved on the ground inclined upward to the left, the first linear motion mechanisms 22 are driven in such a way that the front wheel 11L will become higher than the front wheel 11R. That is, the first linear motion mechanism 22L is made shorter than the first linear motion mechanism 22R. Further, the second linear motion mechanisms 23 are driven in such a way that the middle wheel 12L will become higher than the middle wheel 12R, and the rear wheel 13L will become higher than the rear wheel 13R. Then, the right and left lower links 25 will have angles different from each other. It is obvious that in the case of the ground inclined upward to the right, the variable mechanism 20 is driven in such a way that the front wheel 11R, the middle wheel 12R, and the rear wheel 13R will become higher than the front wheel 11L, the middle wheel 12L, and the back 13L, respectively. By doing so, the vehicle 1 can be moved on an inclined ground while the seating surface of the riding seat 3 remains level. Thus, the ride quality can be improved, and the vehicle 1 can stably travel.

FIG. 14 shows a case in which the vehicle 1 is moved a ground inclined to the right or left in the travelling mode. The front wheel 11R, the middle wheel 12R, and the rear wheel 13R are at positions lower than the front wheel 11L, the middle wheel 12L, and the rear wheel 13L, respectively. In this way, the vehicle 1 can travel on an inclined ground while providing the occupant with improved ride quality.

As described above, the variable mechanism 20 can greatly change the height of wheels by a small stroke. Thus, a pitch angle, a roll angle, and a height of the seat surface can be adjusted while the vehicle 1 is travelling. Further, as the first linear motion mechanisms 22 and the second linear motion mechanisms 23 are driven independently on the right and left sides, the vehicle 1 can stably travel on right and left steps, right and left inclinations, and uneven terrains. As the variable mechanism 20 adjusts heights of the trailing and driving wheels, the vehicle 1 can travel on steps and uneven terrains while the seating surface remains level. Moreover, the vehicle 1 has a travelling performance that is equivalent to that of mobility scooters and can travel more safely and comfortably than the mobility scooters do. As the height can be freely changed, the vehicle 1 offers improved convenience. For example, an occupant can move with the same eye level as those of pedestrians. Both the standing riding mode that facilitates an occupant to access high places and the chair mode that enables the vehicle 1 to move under the table 1 while an occupant is sitting can be achieved.

When the vehicle 1 climbs or goes down steps, the vehicle 1 travels on the six wheels. On the other hand, when the vehicle 1 travels normally or goes on and off escalators, the variable mechanism 20 is changed to the four-wheel grounded state. As the first linear motion mechanisms 22 and the second linear motion mechanisms 23 are controlled independently from one another while the vehicle 1 travels, four-wheel independent active suspension can be achieved. With the four-wheel independent active suspension, oscillation of the seating surface can be reduced, thereby improving safety and ride quality. For example, the variable mechanism 20 is driven in such a way that the seating surface is tilted forward at the time of acceleration and tilted backward at the time of deceleration. Alternatively, when the vehicle 1 turns a curb, the ground is inclined to the side of the ground in such a way that an external side of the curbed ground will become high. This enables the vehicle 1 to stably travel and improves ride quality.

The variable mechanism 20 operates based on a result of the detection by the sensor unit 73. It is thus possible to achieve movements with a high travelling performance under various environments such as uneven terrains, steps, grounds inclined forward, backward, to the right, or to the left, escalators, or the like. Further, the vehicle 1 can travel while the seating surface remains level under various environments. Front legs to which the front wheels 11 are attached and rear legs to which the middle wheels 12 are attached are driven by the linear motion mechanisms. Thus, the number of actuators can be reduced, thereby reducing the size and weight of variable mechanism 20. It is thus possible to simplify the structure of the variable mechanism 20.

Additionally, it is thus easy for an occupant to get on and off welcab vehicles and the like. For example, the vehicle 1 can travel slopes when the occupant gets on and off a welcab vehicle or the like while the seating surface remains level. The vehicle 1 can travel sidewalks that are inclined or have steps while the seating surface remains level. Moreover, the vehicle 1 can get on non-step buses and trains while the occupant 2 is on the vehicle 1. The vehicle 1 can climb and go down large steps such as curbstones on sidewalks and steps at front doors.

When the vehicle 1 climbs or goes down steps or gets on or off escalators, the laser range scanner and the like in the sensor unit 73 may detect the steps or the escalators in front. That is, the sensor unit 73 detects heights of the steps or presence of up or down escalators. The control system 70 may control the variable mechanism 20 according to the detected steps or escalators. For example, the control unit 71 controls the respective actuators of the variable mechanism 20 based on a detection signal of the sensor 73. To be more specific, when a step is detected in front, the control unit 71 switches the mode of the vehicle 1 from the travelling mode to the chair mode. When the vehicle 1 travels slopes, in a manner similar to the above, the control unit 71 controls the respective actuators of the variable mechanism 20 based on a detection signal of the sensor 73. Alternatively, the control unit 71 may start controlling the variable mechanism 20 in response to an operation by a user. That is, the variable mechanism 20 may operate when the user specifies getting on or off a step, an up escalator, or a down escalator.

Note that rollers may be provided to project from the links at the back of the rear wheels 13. In this way, the rollers can be pushed against a vertical surface of the down escalator in order to stabilize the vehicle body. It is thus possible to prevent the rear wheels 13 from being frictioned in the vertical direction of the down escalator. Although in the above descriptions it has been described that the vehicle 1 has three wheels on each side thereof, for a total of six wheels, the number of the wheels on one side may be three or more. Further, the middle wheels 12 or the rear wheels 13 may be driving wheels.

Second Exemplary Embodiment

Figure 15:
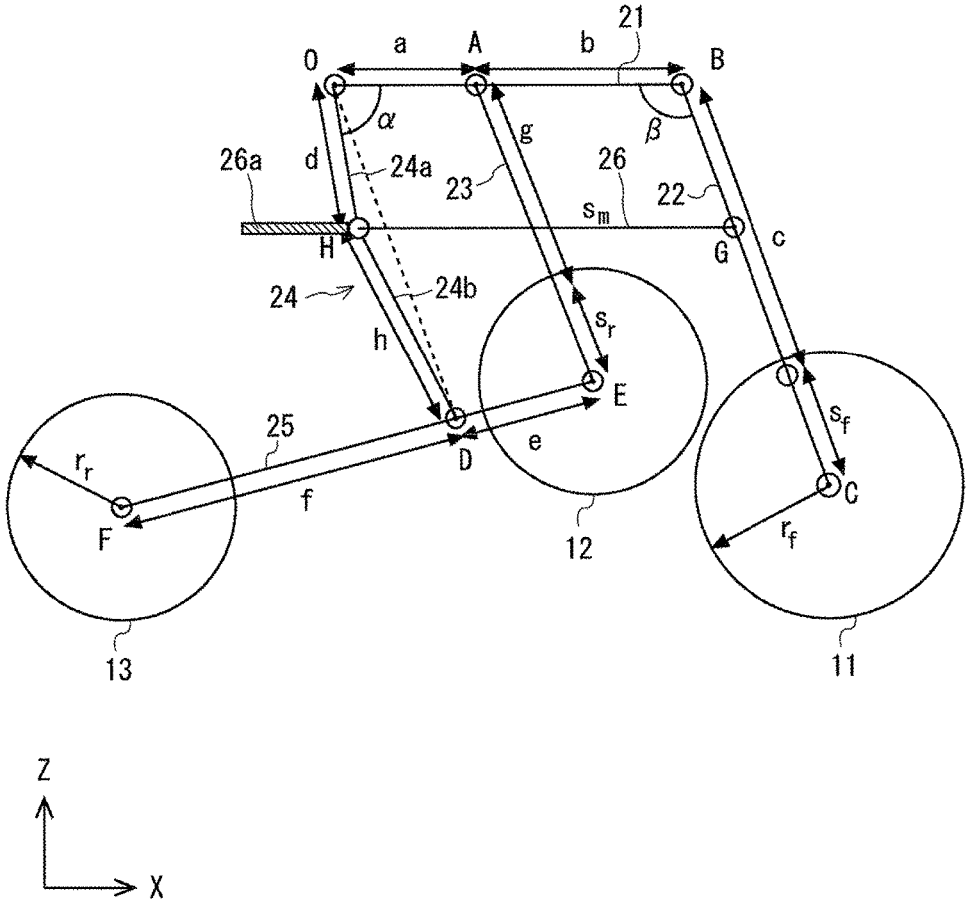
FIG. 15 is a model diagram showing a structure of a variable mechanism of a vehicle according to a second exemplary embodiment.

A travelling apparatus according to a second exemplary embodiment will be described by referring to FIG. 15. Also in this exemplary embodiment, the travelling apparatus described is a vehicle similar to that of the first exemplary embodiment. FIG. 15 is a model diagram showing a structure of a variable mechanism of a travelling apparatus according to the second exemplary embodiment. In this exemplary embodiment, the structure of the variable mechanism differs from the first exemplary embodiment. In the second exemplary embodiment, a position where the third linear motion mechanism 26 is attached differs from the first exemplary embodiment. As the structure other than the third linear motion mechanism 26 is the same as that of the first exemplary embodiment, description thereof will be omitted.

The third linear motion mechanism 26 is provided in an extendable and retractable manner between the first linear motion mechanisms 22 and the rear links 24. To be more specific, one end of the third linear motion mechanism 26 is attached to the first linear motion mechanisms 22 at a point halfway between both ends of the first linear motion mechanisms 22. Further, the other end of the third liner motion mechanism 26 is attached to the rear links at a point halfway between both ends of the rear links 24, respectively. Accordingly, the rear links 24 each have an upper rear link 24*a* and a lower rear link 24*b*.

The third linear motion mechanism 26 is attached at a position H where the upper rear link 24*a* is connected to the lower rear link 24*b*. The length of the upper rear link 24*a* is d, and the length of the lower rear link 24*b* is h. That is, a distance between the positions O and H is d, and a distance between positions H and D is h. The rear links 24 are bent at the position H. The third linear motion mechanism 26 is attached to parts of the first linear motion mechanisms 22 that are not extended or retracted. That is, the first linear motion mechanisms 22 are extended and retracted at positions lower than the position to which the third linear motion mechanism 26 is attached.

The angle $\alpha$ is changed when the third linear motion mechanism 26 is extended or retracted. That is, the angle $\alpha$ between the upper frame 21 and the upper rear links 24*a* is variable. To be more specific, when the third linear motion mechanism 26 is extended, the angle $\alpha$ is increased, while when the third linear motion mechanism 26 is retracted, the angle $\alpha$ is reduced. The angle may be fixed between the upper rear link 24*a* and the lower rear link 24*b*. Alternatively, the angle may be variable between the upper rear link 24*a* and the lower rear link 24*b*. In this case, the upper rear link 24*a* and the lower rear link 24*b* are connected to each other with a passive joint interposed therebetween.

Figure 16:
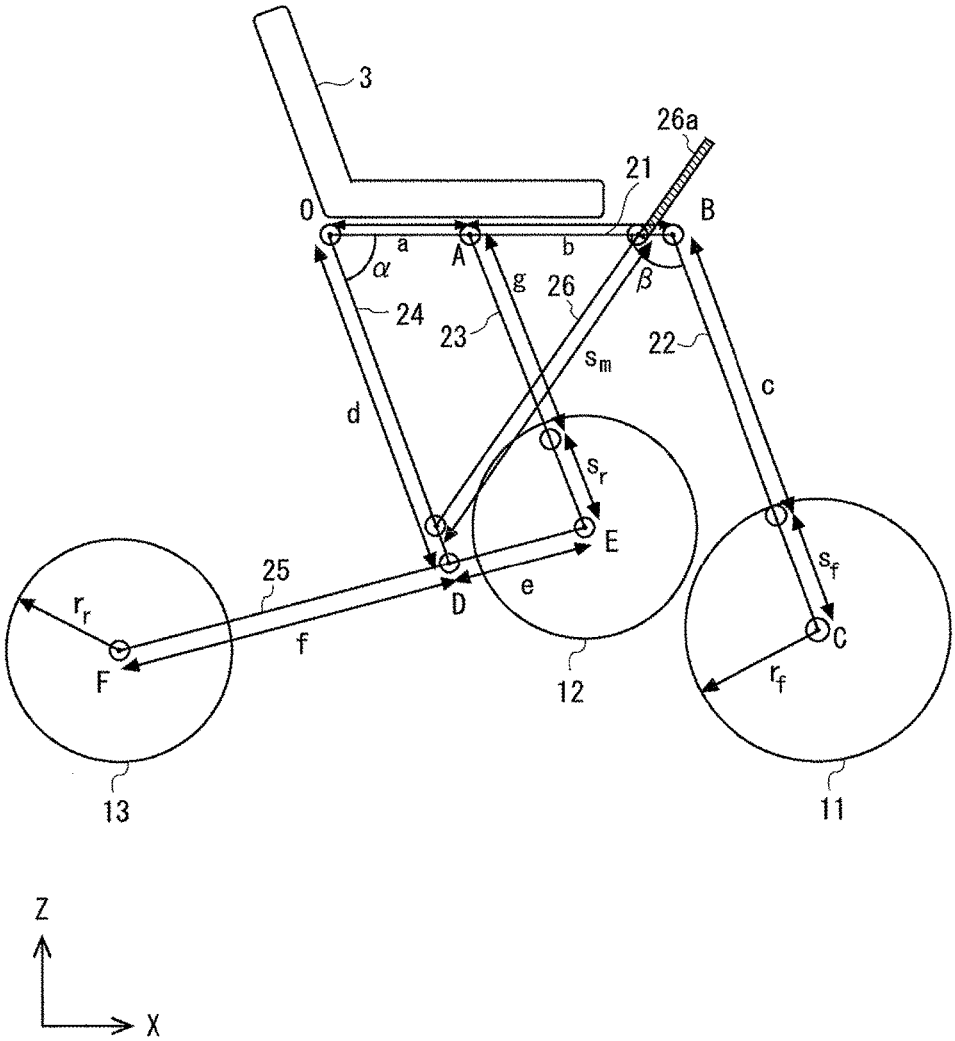
FIG. 16 is a drawing schematically showing a structure of a vehicle when a third linear motion mechanism has a projection.

With such a structure, the same advantages as those achieved by the first exemplary embodiment can be achieved. Further, collisions between the third linear motion mechanism 26 and the occupant can be prevented. In this regard, a comparison between FIGS. 15 and 16 will be used for the following description. FIG. 16 is a model diagram showing the variable mechanism according to the first exemplary embodiment and shows the riding seat 3 as well.

In regard to an actual actuator of the third linear motion mechanism 26, there may be a projection 26*a* that projects from a movable range. If the projection 26*a* projects toward the lower left side of FIG. 16, it may be brought into contact with the ground. Thus, the projection 26*a* projects toward the upper right side of FIG. 16. However, if the projection 26*a* greatly projects toward the upper right side of FIG. 16, the projection 26*a* passes near the riding seat 3, and thus the projection 26*a* projects between the legs of the occupant 2 who is riding on the riding seat 3. This could affect the occupant 2 getting on and off the vehicle or operability of the vehicle 1.

On the other hand, in this exemplary embodiment, the projection 26*a* of the third linear motion mechanism 26 projects backward as shown in FIG. 15. Accordingly, the projection 26*a* will not be brought into contact with the ground, and thus there will be no collision between the occupant 2 and the projection 26*a*. Therefore, even when the third linear motion mechanism 26 has the projection 26*a*, the vehicle 1 can have a desirable structure. It is thus possible for the vehicle 1 to travel without any collision with the occupant 2 and the ground. Additionally, the occupant 2 will not be hindered from getting on and off the vehicle 1.

(Change in Vehicle Height)

Figure 17:
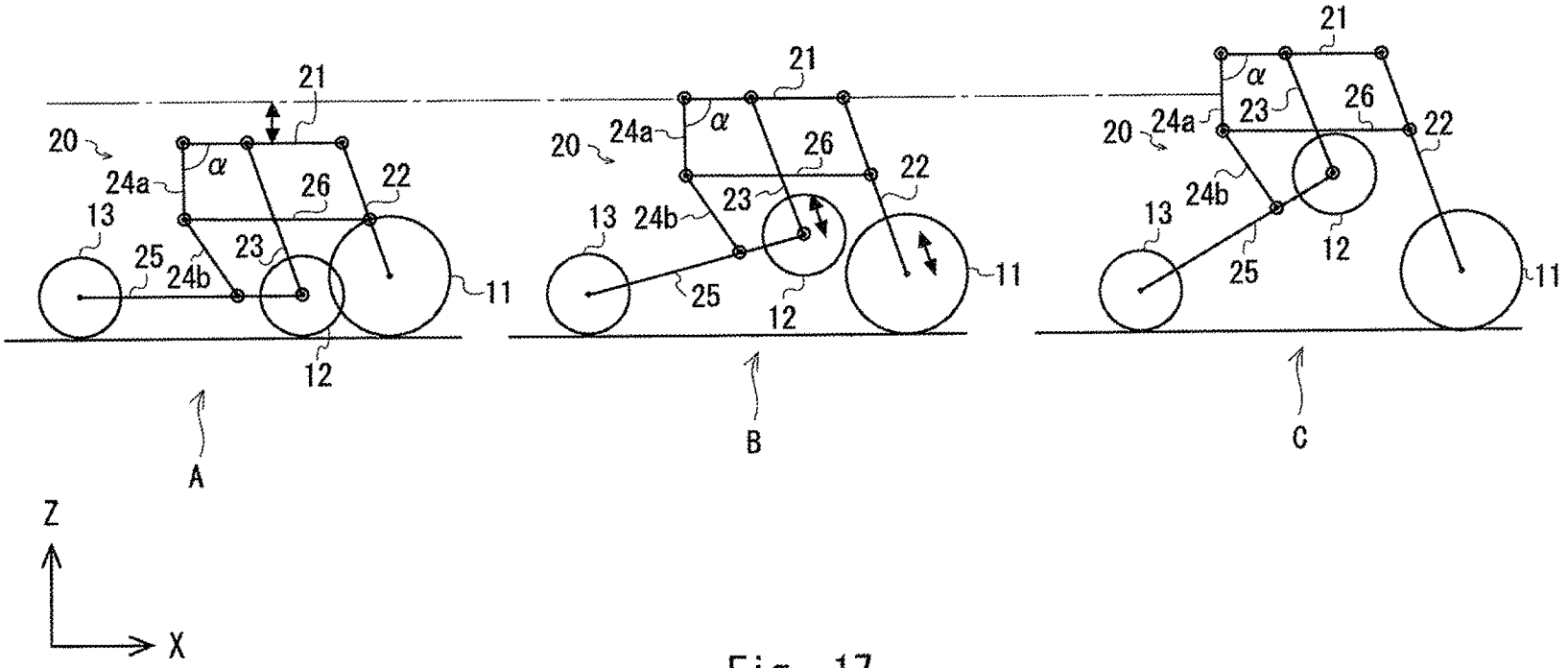
FIG. 17 is a model diagram showing a structure of the variable mechanism in respective modes of the vehicle according to the second exemplary embodiment.

Next, respective modes of the travelling apparatus according to the second exemplary embodiment will be described. FIG. 17 shows the chair mode, the travelling mode, and the standing riding mode. To be more specific, in FIG. 17, the state A shows the chair mode, the state B shows the travelling mode, and a state C shows the standing riding mode. In the chair mode, the front wheels 11, the middle wheels 12, and the rear wheels 13 are grounded. In the travelling mode and the standing riding mode, the front wheels 11 and the rear wheels 13 are grounded, and the middle wheels 12 are off the ground.

As shown in FIG. 17, when the first linear motion mechanisms 22 and the second linear motion mechanisms 23 are extended or retracted, the vehicle height can be changed. That is, in a manner similar to the first exemplary embodiment, when the first linear motion mechanisms 22 are extended, and the second linear motion mechanisms 23 are retracted, the vehicle height can be increased. In a manner similar to the first exemplary embodiment, the angle $\alpha$ and the third linear motion mechanism 26 are constant in all the modes.

(Handling the Vehicle 1 to Get it on and Off Escalators)

Figure 18:
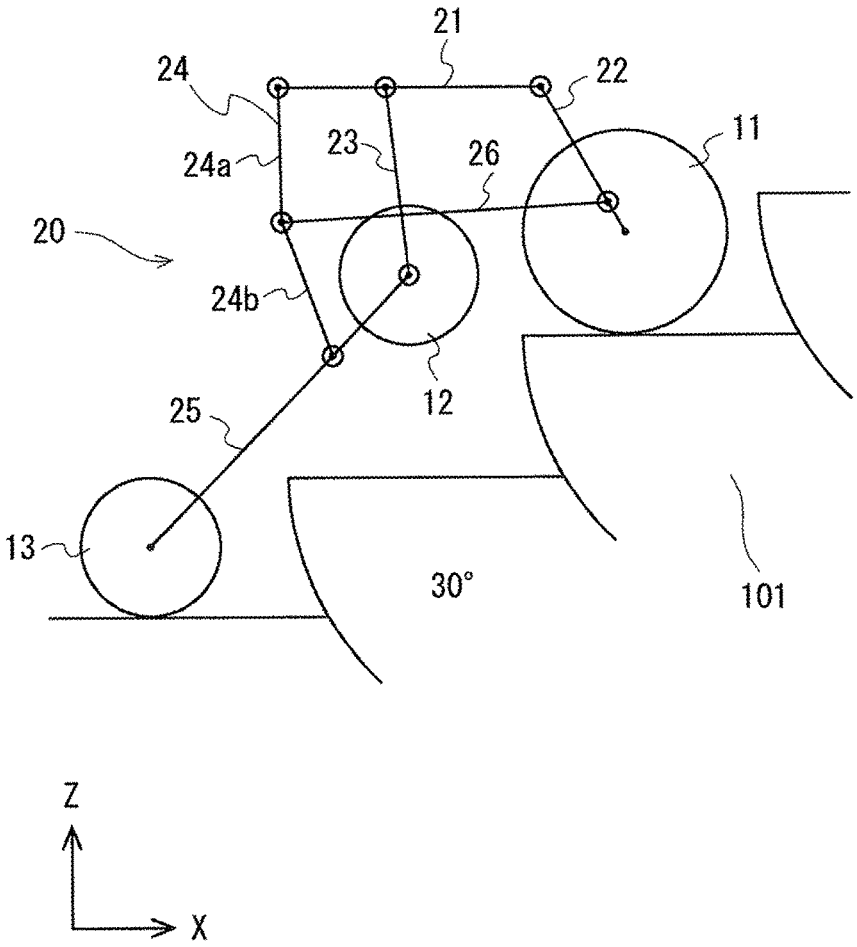
FIG. 18 is a model diagram showing the variable mechanism in a state in which the vehicle according to the second exemplary embodiment is on an up escalator.
Figure 19:
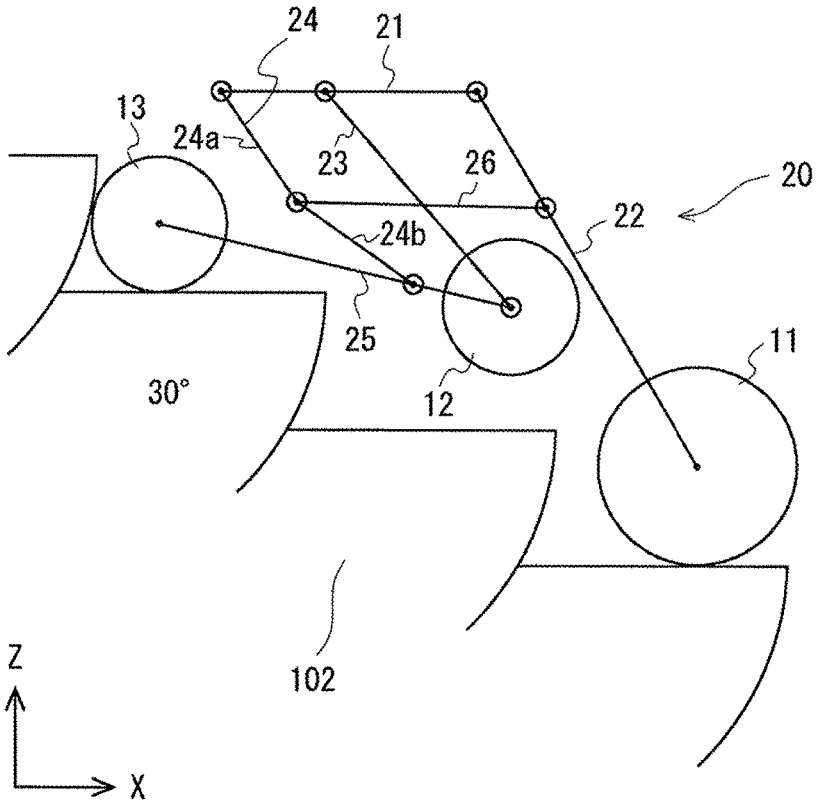
FIG. 19 is a model diagram showing the variable mechanism in a state in which the vehicle according to the second exemplary embodiment is on a down escalator.

A state in which the vehicle 1 is on an escalator will be described by referring to FIGS. 18 and 19. FIG. 18 shows a state in which the vehicle 1 is on an up escalator 101, and FIG. 19 shows a state in which the vehicle 1 is on a down escalator 102. Note that as basic operations of the variable mechanism 20 are the same as those described in the first exemplary embodiment, descriptions will be omitted as appropriate. For example, extending and retracting operations of the second linear motion mechanisms 23 and the first linear motion mechanisms 22 are the same as those described in the first exemplary embodiment. The third linear motion mechanism 26 is extended and retracted in the same manner as that described in the first exemplary embodiment.

When the vehicle 1 gets on the up escalator 101, the third linear motion mechanism 26 is extended, as shown in FIG. 18. Then, the angle $\alpha$ between the upper frame 21 and the upper rear links 24*a* will be increased. Accordingly, even when the front wheels 11 become higher than the rear wheels 13, the upper frame 21 will become close to level. Therefore, even when the occupant 2 is sitting on the riding seat 3 (not shown in FIG. 18) that is attached to the upper frame 21, the occupant 2 can stably get on the up escalator 101.

When the vehicle 1 gets on the down escalator 102, the third linear motion mechanism 26 is extended, as shown in FIG. 19. Then, the angle α between the upper frame 21 and the upper rear links 24*a* will be reduced. Thus, the variable mechanism 20 operates with a posture similar to that in the first exemplary embodiment. Accordingly, even when the front wheels 11 become lower than the rear wheels 13, the upper frame 21 will become close to level. Therefore, even when the occupant 2 is sitting on the riding seat 3 (not shown in FIG. 19) that is attached to the upper frame 21, the occupant 2 can stably get on the down escalator 101.

(Handling the Vehicle 1 to Climb and Going Down Steps)

Figure 20:
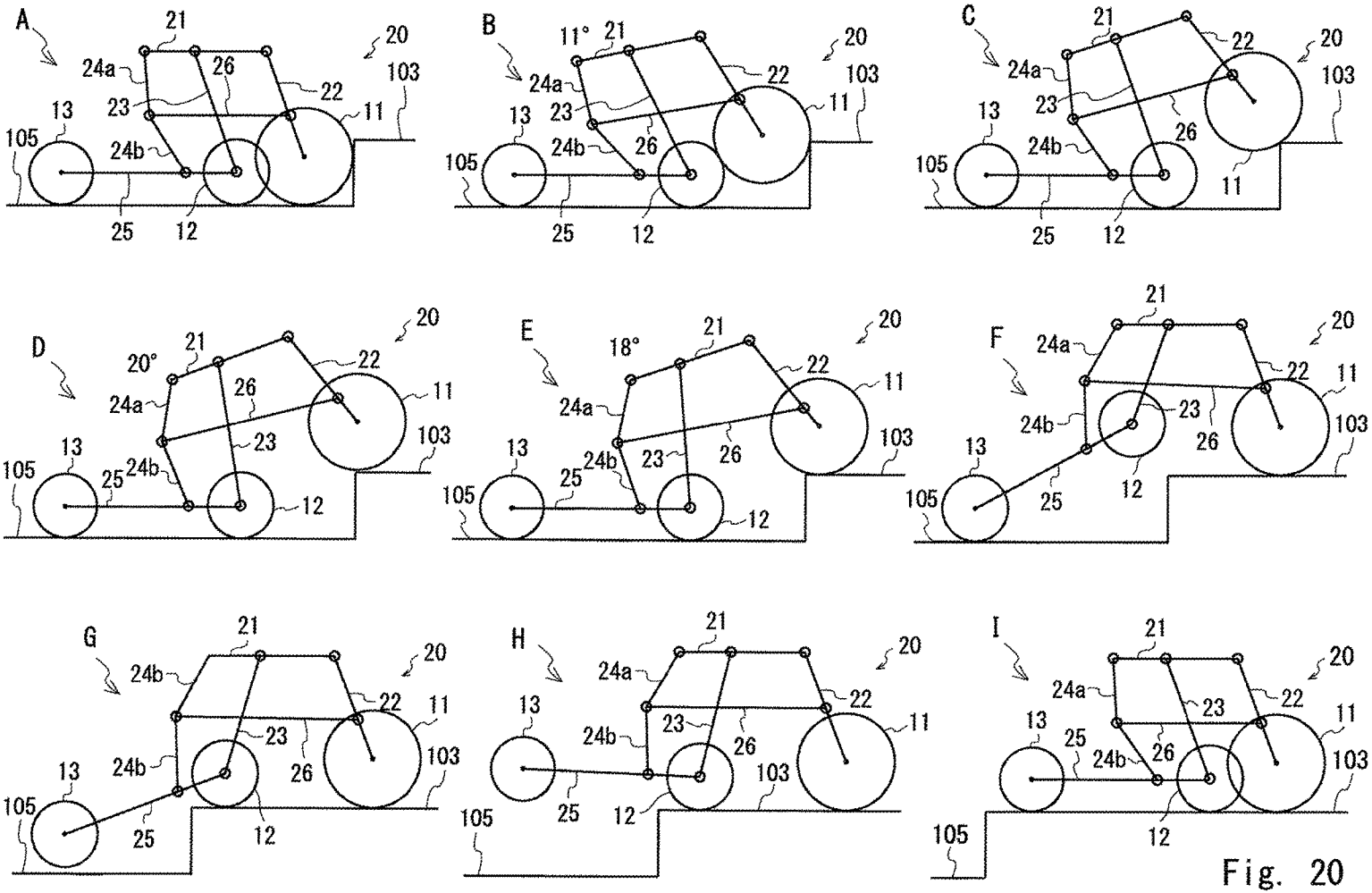
FIG. 20 is a model diagram showing the structure of the variable mechanism when the vehicle according to the second exemplary embodiment climbs a step.
Figure 21:
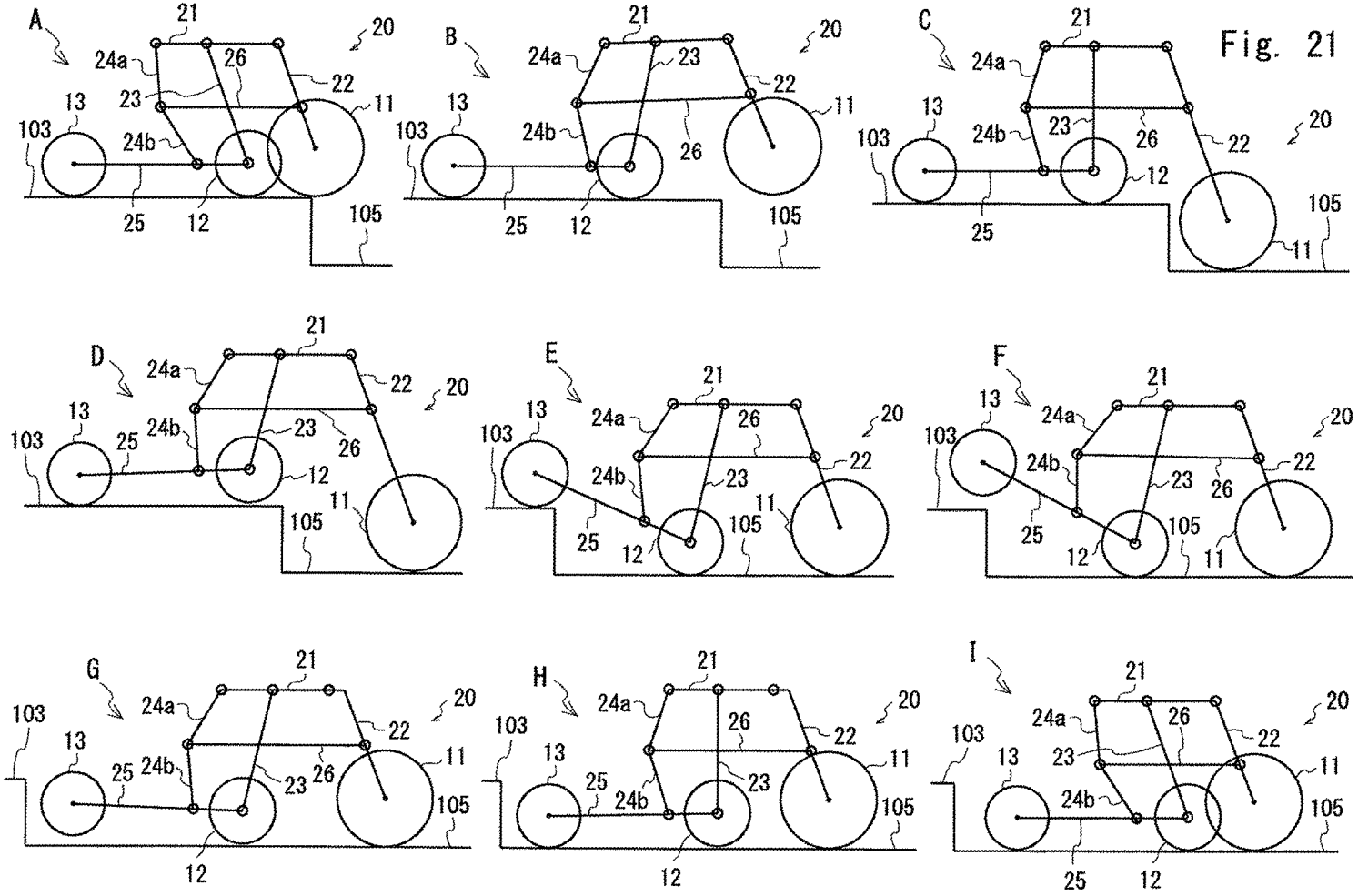
FIG. 21 is a model diagram showing the structure of the variable mechanism when the vehicle according to the second exemplary embodiment goes down a step.

Next, an operation of the variable mechanism 20 when the vehicle 1 climbs or goes down a step will be described. FIG. 20 is a model diagram showing an operation of the variable mechanism 20 when the variable mechanism 20 goes over a step 103. FIG. 21 is a model diagram showing an operation of the variable mechanism 20 when the variable mechanism 20 goes down the step 103. In FIGS. 20 and 21, the step 103 is present on a level floor surface 105. Further, a top surface of the step 103 is also level. Note that unlike FIGS. 12 and 13, in FIGS. 20 and 21, the lengths of the respective linear motion mechanisms are not shown.

When the vehicle 1 climbs the step 103, the state of the variable mechanism 20 is changed in the order of timings A to I in FIG. 20. As the basic operations of the vehicle 1 when the vehicle 1 climbs a step are the same as those described in the first exemplary embodiment, the descriptions thereof will be omitted. For example, extending and retracting operations of the second linear motion mechanisms 23 and the first linear motion mechanisms 22 are the same as those described in the first exemplary embodiment. The third linear motion mechanism 26 is extended and retracted in the same manner as that described in the first exemplary embodiment. Accordingly, the variable mechanism 20 operates in the manner similar to that shown in FIG. 12.

When the vehicle 1 goes down the step 103, the state of the variable mechanism 20 is changed in the order of timings A to I in FIG. 21. As the basic operations of the vehicle 1 when the vehicle 1 goes down a step are the same as those described in the first exemplary embodiment, the descriptions thereof will be omitted. For example, extending and retracting operations of the second linear motion mechanisms 23 and the first linear motion mechanisms 22 are the same as those described in the first exemplary embodiment. The third linear motion mechanism 26 is extended and retracted in the same manner as that described in the first exemplary embodiment. Accordingly, the variable mechanism 20 operates in the manner similar to that shown in FIG. 13.

Note that in the above descriptions, although the travelling apparatus according to this exemplary embodiment has been described as the vehicle 1 on which the occupant 2 rides and that travels, the travelling apparatus according to this exemplary embodiment may be configured not to carry the occupant 2. For example, the travelling apparatus according to this exemplary embodiment may travel with baggage loaded on a carrier. In this case, the carrier is provided on the upper frame 21 for the vehicle body in place of the riding seat 3. Alternatively, the travelling apparatus may carry baggage and the occupant 2 at the same time. In this case, the vehicle body is provided with the riding seat 3 and the carrier. Further alternatively, it is not limited to the travelling apparatus that carries the occupant 2 or baggage and is moved, and instead it may be configured in such a way that only the travelling apparatus itself is moved. For example, the structure of the travelling apparatus is not limited to the one in which the vehicle body is provided with the riding seat and the carrier, and may instead be a mobile robot or the like that autonomously travels. That is, the travelling apparatus may be configured such that the variable mechanism 20 supports the vehicle body. When the riding seat and/or the carrier is provided to the vehicle body, a vehicle on which the occupant 2 rides or a travelling apparatus that carries baggage can be composed.

Note that the present invention is not limited to the above exemplary embodiments, and modifications can be made as appropriate without departing from the scope of the invention.

The present application is based upon and claims the benefit of priority from Japanese Patent Application No. 2014-143572, filed on Jul. 11, 2014, the entire contents of which are hereby incorporated by reference.

REFERENCE SIGNS LIST

1 VEHICLE
2 OCCUPANT
3 RIDING SEAT
4 FOOTREST
5 BACKREST
6 ARMREST
7 CONTROL BOX
8 TABLE
9 SHELF
11 FRONT WHEELS
12 MIDDLE WHEELS
13 REAR WHEELS
20 VARIABLE MECHANISM
21 UPPER FRAME
22 FIRST LINEAR MOTION MECHANISM
23 SECOND LINEAR MOTION MECHANISM
24 REAR LINK
25 LOWER LINK
26 THIRD LINEAR MOTION MECHANISM
101 UP ESCALATOR
102 DOWN ESCALATOR
103 STEP
105 FLOOR SURFACE

The invention claimed is:

1. A travelling apparatus comprising:
a first wheel, the first wheel being a driving wheel;
a vehicle body;
a first linear motion actuator configured to be extendable and retractable and couple the first wheel to the vehicle body;
a second wheel configured to be disposed at a back of the first wheel;
a second linear motion actuator configured to be extendable and retractable and couple the second wheel to the vehicle body;
a third wheel configured to be disposed at a back of the second wheel;
a first link configured to couple the second wheel to the third wheel;
a second link configured to couple the first link to the vehicle body; and
an actuator configured to change an angle between the vehicle body and the second link,
wherein the second wheel and the third wheel are non-driven wheels.

2. The traveling apparatus according to claim 1, wherein the first wheels, the second wheels, the third wheels, the first linear motion actuators, and the second linear motion actuators are arranged on right and left sides of the travelling apparatus and are driven independently on the right and left sides of the travelling apparatus.

3. The travelling apparatus according to claim 2, wherein the actuator is shared by the right and left second links.

4. The travelling apparatus according to claim 2, wherein the actuator includes a third linear motion actuator provided in an extendable and retractable manner between the vehicle body and the second links.

5. The travelling apparatus according to claim 1, wherein the actuator includes a third linear motion actuator provided in an extendable and retractable manner between the vehicle body and the second link.

6. The travelling apparatus according to claim 1, wherein the actuator includes a rotation mechanism configured to drive rotation of the second links with respect to the vehicle body.

7. The travelling apparatus according to claim 1, wherein a riding seat on which an occupant rides is provided to the vehicle body.

8. The travelling apparatus according to claim 1, further comprising:

a controller comprising at least one processor, the at least one processor configured to control a length of the first linear motion actuator, a length of the second linear motion actuator, and the actuator.

9. The travelling apparatus according to claim 8, wherein the first linear motion actuator is a first arm actuator and the second linear motion actuator is a second arm actuator, and the at least one processor is configured to control an arm length of the first arm actuator and an arm length of the second arm actuator.

10. The travelling apparatus according to claim 1, wherein the first linear motion actuator and the second linear motion actuator are configured to change a height of the vehicle body, and the second linear motion actuator and the actuator are configured to change a pitch angle of the vehicle body.

11. The travelling apparatus according to claim 1, wherein the first link is directly connected to the second wheel and the third wheel, and the first linear motion actuator connects the first wheel to a front end of the vehicle body.

12. A travelling apparatus comprising:

a first wheel, the first wheel being a non-driven wheel;

a vehicle body;

a first linear motion actuator configured to be extendable and retractable and couple the first wheel to the vehicle body;

a second wheel configured to be disposed at a back of the first wheel, the second wheel being a driving wheel;

a second linear motion actuator configured to be extendable and retractable and couple the second wheel to the vehicle body;

a third wheel configured to be disposed at a back of the second wheel, the third wheel being a non-driven wheel;

a first link configured to couple the second wheel to the third wheel;

a second link configured to couple the first link to the vehicle body; and an actuator configured to change an angle between the vehicle body and the second link, wherein the actuator includes a third linear motion actuator that is connected to the second link and a front end of the vehicle body and that extends and retracts between the second link and the front end of the vehicle body.

13. The travelling apparatus according to claim 12, further comprising:

a controller comprising at least one processor, the at least one processor configured to control a length of the first linear motion actuator, a length of the second linear motion actuator, and the actuator.

14. The travelling apparatus according to claim 13, wherein the first linear motion actuator is a first arm actuator and the second linear motion actuator is a second arm actuator, and the at least one processor is configured to control an arm length of the first arm actuator and an arm length of the second arm actuator.

15. The travelling apparatus according to claim 12, wherein the first linear motion actuator and the second linear motion actuator are configured to change a height of the vehicle body, and the second linear motion actuator and the actuator are configured to change a pitch angle of the vehicle body.

16. The travelling apparatus according to claim 12, wherein the first link is directly connected to the second wheel and the third wheel, and the first linear motion actuator connects the first wheel to the front end of the vehicle body.

17. A travelling apparatus comprising:

a first wheel, the first wheel being a driving wheel;

a vehicle body;

a first linear motion actuator configured to be extendable and retractable and couple the first wheel to the vehicle body;

a second wheel configured to be disposed at a back of the first wheel;

a second linear motion actuator configured to be extendable and retractable and couple the second wheel to the vehicle body;

a third wheel configured to be disposed at a back of the second wheel;

a first link configured to couple the second wheel to the third wheel;

a second link configured to couple the first link to the vehicle body; and an actuator configured to change an angle between the vehicle body and the second link, wherein the actuator includes a third linear motion actuator provided in an extendable and retractable manner between the vehicle body and the second link, and the third linear motion actuator is connected to the second link and a front end of the vehicle body and extends and retracts between the second link and the front end of the vehicle body.

* * * * *